US008084932B2

(12) United States Patent
Suwa et al.

(10) Patent No.: US 8,084,932 B2
(45) Date of Patent: Dec. 27, 2011

(54) ELECTRON BEAM APPARATUS AND IMAGE DISPLAY APPARATUS USING THE SAME

(75) Inventors: Takanori Suwa, Kawasaki (JP); Hisanobu Azuma, Hadano (JP); Toshiharu Sumiya, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 100 days.

(21) Appl. No.: 12/770,201

(22) Filed: Apr. 29, 2010

(65) Prior Publication Data

US 2010/0289399 A1 Nov. 18, 2010

(30) Foreign Application Priority Data

May 14, 2009 (JP) ..... 2009-117392

(51) Int. Cl.
*H01J 1/62* (2006.01)

(52) U.S. Cl. ..... 313/495; 313/446

(58) Field of Classification Search ..... 313/495, 313/446

See application file for complete search history.

(56) References Cited

U.S. PATENT DOCUMENTS

| | | | | |
|---|---|---|---|---|
| 3,970,887 | A * | 7/1976 | Smith et al. | 313/309 |
| 5,144,191 | A * | 9/1992 | Jones et al. | 313/308 |
| 5,214,346 | A * | 5/1993 | Komatsu | 313/309 |
| 5,249,340 | A * | 10/1993 | Kane et al. | 445/50 |
| 5,391,956 | A * | 2/1995 | Watanabe et al. | 313/309 |
| 5,769,679 | A | 6/1998 | Park et al. | 445/50 |
| 6,703,791 | B2 | 3/2004 | Azuma | 315/169.3 |
| 6,972,203 | B2 | 12/2005 | Azuma | 438/20 |
| 7,151,005 | B2 | 12/2006 | Azuma | 438/20 |
| 7,381,578 | B2 | 6/2008 | Azuma | 438/20 |
| 7,382,088 | B2 | 6/2008 | Azuma et al. | 313/495 |
| 7,427,826 | B2 | 9/2008 | Iba et al. | 313/236 |
| 7,427,830 | B2 | 9/2008 | Taniguchi et al. | 313/495 |
| 7,507,134 | B2 | 3/2009 | Iba et al. | 445/5 |
| 7,710,010 | B2 | 5/2010 | Iba et al. | 313/477 R |
| 7,733,003 | B2 | 6/2010 | Hiroki et al. | 313/495 |
| 7,969,082 | B2 * | 6/2011 | Takada et al. | 313/448 |
| 2008/0238287 | A1 | 10/2008 | Iba et al. | 313/458 |
| 2008/0309592 | A1 | 12/2008 | Ohashi et al. | 345/75.2 |
| 2009/0009438 | A1 | 1/2009 | Kanai et al. | 345/75.2 |
| 2009/0058252 | A1 | 3/2009 | Takada et al. | 313/310 |
| 2009/0072697 | A1 | 3/2009 | Hiroki et al. | 313/326 |
| 2010/0060137 | A1 * | 3/2010 | Takada et al. | 313/448 |
| 2010/0283380 | A1 * | 11/2010 | Taniguchi et al. | 313/497 |
| 2011/0006666 | A1 * | 1/2011 | Sumiya et al. | 313/496 |

FOREIGN PATENT DOCUMENTS

| | | |
|---|---|---|
| EP | 0 739 022 A2 | 10/1996 |
| JP | 2000-277001 | 10/2000 |
| JP | 2001-167693 A | 6/2001 |
| JP | 2003-151456 | 5/2003 |

OTHER PUBLICATIONS

European Search Report issued by the European Patent Office in European Application No. 10159852.2.—6 pages.

* cited by examiner

*Primary Examiner* — Peter Macchiarolo
(74) *Attorney, Agent, or Firm* — Fitzpatrick, Cella, Harper & Scinto

(57) ABSTRACT

Deformation of a gate by Coulomb force generated when operating an electron-emitting device is inhibited by appropriately maintaining relationship between film thickness h of the gate and distance L from an outer surface of an insulating member to an inner surface of a concave portion. According to this, in an electron beam apparatus provided with a laminate-type electron-emitting device, the deformation of the gate is prevented to reduce variation in electron emission characteristics, thereby preventing the element from being broken.

4 Claims, 15 Drawing Sheets

ELECTRON BEAM APPARATUS AND IMAGE DISPLAY APPARATUS USING THE SAME

BACKGROUND OF THE INVENTION

1. Field of the Invention

The present invention relates to an electron beam apparatus provided with an electron-emitting device that emits an electron used in a flat panel display and an image display apparatus using the same.

2. Description of the Related Art

Conventionally, there are electron-emitting devices in which a number of electrons emitted from a cathode collide with an opposed gate and the scattered electrons are taken out. A laminate-type electron-emitting device is one type of such electron-emitting devices, which has a concave portion (recess portion) on an insulating layer in the vicinity of an electron emitting unit and is disclosed in the Japanese Patent Application Laid-Open Publication No. 2001-167693.

SUMMARY OF THE INVENTION

In the laminate-type electron-emitting device provided with the concave portion on the insulating layer, attracting force is generated between the gate and the cathode by Coulomb force and there is a chance that deformation of the gate may occur and electron emission characteristics may vary. Also, when the gate is deformed, there is a problem that distance between the gate and the cathode varies to further increase the attracting force between the gate and the cathode and the gate is further deformed.

An object of the present invention is to solve the above-described problem and to prevent the gate from being deformed, thereby reducing variation in the electron emission characteristics and preventing the element from being broken in the electron beam apparatus provided with the laminate-type electron-emitting device.

In one aspect, the present invention is directed to an electron beam apparatus, which includes an insulating member having a concave portion on a surface thereof;

a gate located on the surface of the insulating member;

a cathode having a protrusion portion protruding from an edge of the concave portion toward the gate, the protrusion portion located on the surface of the insulating member so as to be opposed to the gate; and an anode arranged so as to be opposed to the protrusion portion with the gate interposed between the protrusion and the anode, wherein following conditions are satisfied:

$$L/h \leqq 0.8\times((2\times d^3\times Y)/(27\times c1\times \epsilon 0\times(d\times X/T2)\times Vf^2))^{1.0/3}$$

and $$2.7\times T2 \leqq L,$$

where, $\epsilon 0$ [F/m] is the vacuum permittivity,

Y [Pa] is a Young's modulus of the gate,

Vf [V] is voltage to be applied between the gate and the cathode, d [m] is minimum distance between the gate and the protrusion of the cathode, dav [m] is an average value of the distance between the gate and the protrusion of the cathode, a load coefficient $c1=0.94\times(d/dav)^{1.78}$, h [m] is film thickness of the gate, T2 [m] is thickness of a portion having the concave portion of the insulating member, L [m] is distance from an outer surface of the gate to an inner surface of the concave portion, and X [m] is intruding distance of the cathode into the concave portion.

In another aspect, the present invention is directed to an electron beam apparatus, which includes an insulating member having a concave portion on a surface thereof;

a gate located on the surface of the insulating member;

a cathode having a protrusion portion protruding from an edge of the concave portion toward the gate, the protrusion portion located on the surface of the insulating member so as to be opposed to the gate; and an anode arranged so as to be opposed to the protrusion portion with the gate interposed between the protrusion and the anode, wherein following conditions are satisfied:

$$L \leqq 0.8\times((2\times d^3\times Y)/(27\times c1\times \epsilon 0\times(d\times X/T2)\times Vf^2))^{1.0/3}\times h1\times(0.5+0.5\times(h2/h1)^{0.5})$$ and $$2.7\times T2 \leqq L,$$

where, $\epsilon 0$ [F/m] is the vacuum permittivity,

Y [Pa] is a Young's modulus of the gate,

Vf [V] is voltage to be applied between the gate and the cathode, d [m] is minimum distance between the gate and the protrusion, dav [m] is an average value of the distance between the gate and the protrusion, a load coefficient $c1=0.94\times(d/dav)^{1.78}$, h1 [m] is film thickness on a position on an inner surface of the concave portion of the gate, h2 [m] is film thickness on an outer surface of the gate, T2 [m] is thickness of a portion having the concave portion of the insulating member, L [m] is distance from an outer surface of the gate to an inner surface of the concave portion, and X [m] is intruding distance of the cathode into the concave portion.

In yet another aspect, the present invention is directed to an image display apparatus, which includes:

the above-described electron beam apparatus; and a light emitting member located so as to be laminated on the anode.

The present invention inhibits the deformation of the gate by the Coulomb force between the gate and the cathode generated when driving the electron-emitting device and stable electron emission characteristics may be achieved. Therefore, in the image display apparatus using the electron beam apparatus of the present invention, the stable image display may be maintained.

Further features of the present invention will become apparent from the following description of exemplary embodiments with reference to the attached drawings.

DESCRIPTION OF THE EMBODIMENTS

A preferred embodiment of the present invention will be hereinafter described in detail in an illustrative manner with reference to the drawings. However, dimensions, materials, shapes and relative arrangement of components described in this embodiment are not intended to limit the scope of the invention only thereto, except specifically described.

An electron beam apparatus of the present invention is provided with an electron-emitting device that emits an electron and an anode to which the electron emitted from the electron-emitting device reaches. The electron-emitting device according to the present invention is provided with an insulating member having a concave portion on a surface thereof and a gate and a cathode located on the surface of the insulating member. The cathode has a protrusion portion protruding from an edge of the concave portion toward the gate, and the protrusion portion is located so as to be opposed to the gate. Further, length of the protrusion portion in a direction along the edge of the concave portion is made shorter than length of a portion opposed to the protrusion of the gate in the direction. The anode is arranged so as to be opposed to the protrusion across the gate.

[Overview of Configuration]

Figure 1A:
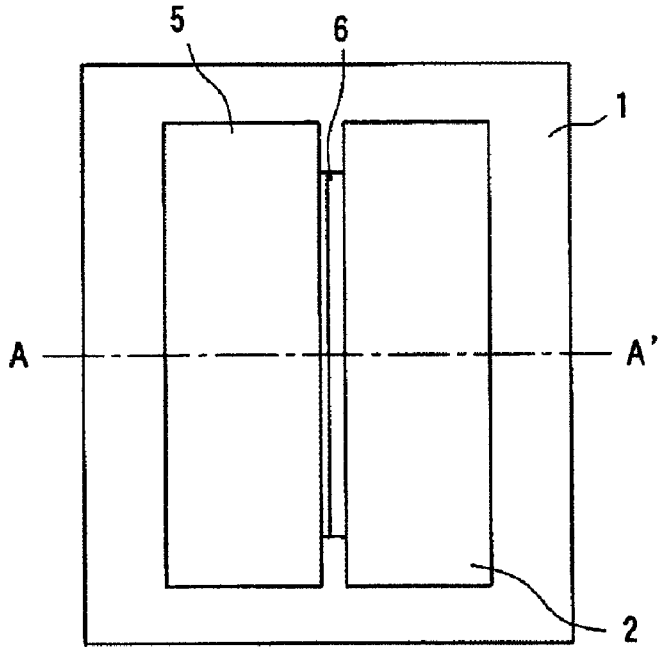
FIGS. 1A to 1C are views schematically illustrating a configuration of an electron-emitting device according to one embodiment of the present invention.
Figure 1B:
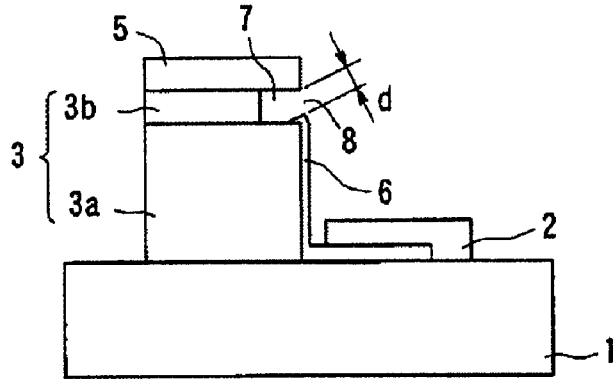
Figure 1C:
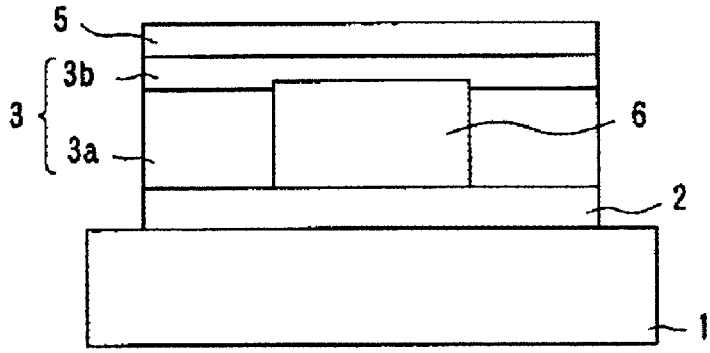

FIG. 1A is a plane schematic view of the electron-emitting device according to one embodiment of the present invention, FIG. 1B is a cross-sectional view taken along line A-A' in FIG. 1A, and FIG. 1C is a side view of the device in FIG. 1B seen from a right side of a plane of paper.

In FIGS. 1A to 1C, reference numerals 1 and 2 represent a substrate and an electrode, respectively, and a reference numeral 3 represents the insulating member obtained by laminating insulating layers 3*a* and 3*b*. A reference numerals 5 represents the gate and a reference numeral 6 represents the cathode, which is electrically connected to the electrode 2. A reference numeral 7 represents a concave portion of the insulating member 3 formed by recessing only a side surface of the insulating layer 3*b* inward with respect to the insulating layer 3*a* in this example. A reference numeral 8 represents a gap (shortest distance d from a tip end of the cathode 6 to a bottom surface of the gate 5) in which an electric field required for emitting the electron is formed.

In the electron-emitting device according to the present invention, as illustrated in FIGS. 1A to 1C, the gate 5 is formed on the surface (upper surface in this example) of the insulating member 3. The cathode 6 also is formed on the surface (side surface in this example) of the insulating member 3 and has the protrusion portion protruding from the edge of the concave portion 7 toward the gate 5 on a side opposed to the gate 5 across the concave portion 7. Therefore, the protrusion portion of the cathode 6 is opposed to the gate 5 across the gap 8. Meanwhile, in the present invention, electric potential of the cathode 6 is set to be lower than that of the gate 5. Also, although not illustrated in FIG. 1, on a position opposed to the cathode 6 across the gate 5 (that is, with the gate 5 interposed therebetween), there is the anode of which electric potential is set to be higher than that of them (reference numeral 20 in FIG. 3).

Figure 2:
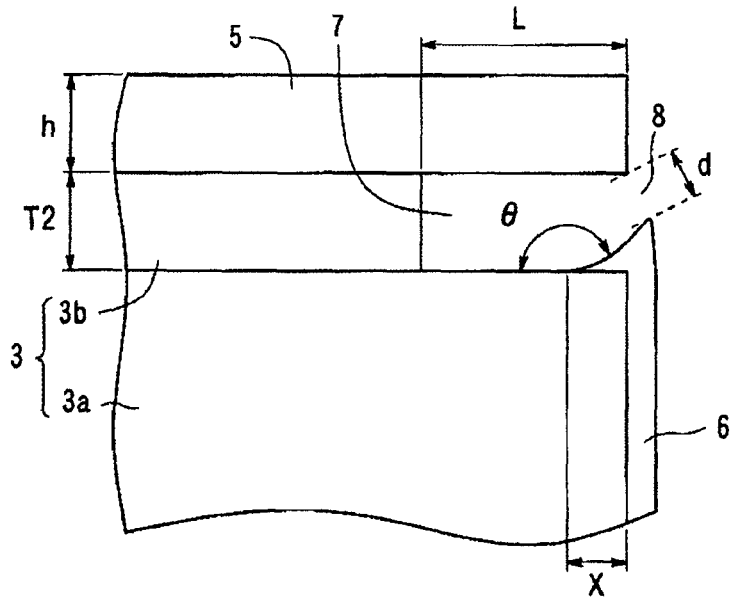
FIG. 2 is an enlarged view around a concave portion of the device shown in FIG. 1.

FIG. 2 is an enlarged view of a portion around the concave portion 7 of the element in FIG. 1B. As illustrated in FIG. 2, the cathode 6 is formed into a shape intruding into on an inner surface of the concave portion 7 by distance X. The distance X is set approximately 10 to 30 nm and is desirably set to be longer than 20 nm. However, when the distance X is too long, leak occurs between the cathode 6 and the gate 5 along inner surface of the concave portion 7 (side surface of the insulating layer 3*b*) and leak current increases.

[Electric Source/Electric Potential]

Figure 3:
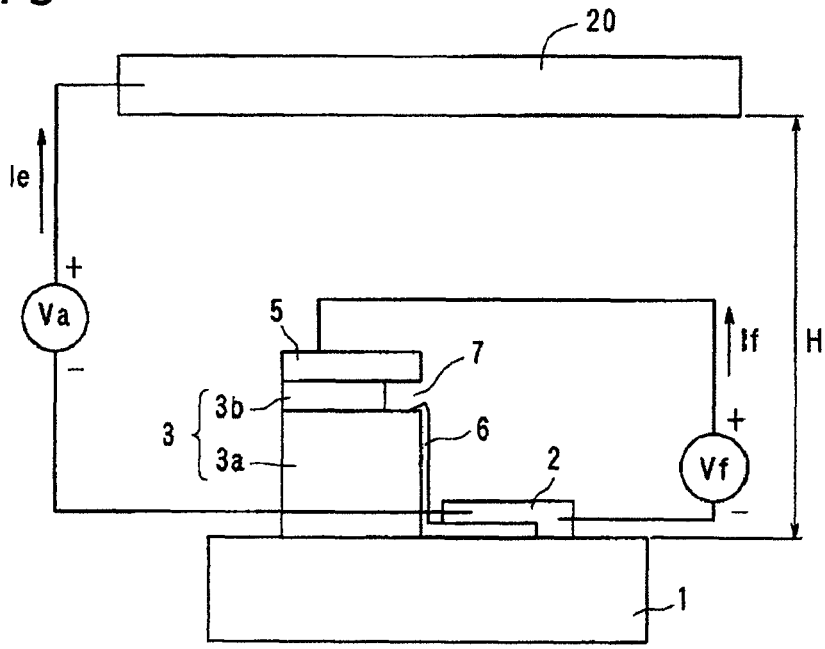
FIG. 3 is a schematic diagram illustrating power supply arrangement when measuring electron emission characteristics of the element according to the present invention.

FIG. 3 illustrates power supply arrangement when measuring electron emission characteristics of the device according to the present invention. As illustrated in FIG. 3, in the electron beam apparatus of the present invention, the anode 20 is arranged so as to be opposed to the protrusion portion of the cathode 6 across the gate 5. In this example, since the insulating member 3 is arranged on the substrate 1, it may be also said that the anode 20 is arranged so as to be opposed to the substrate 1 on a side of the substrate 1 on which the insulating member 3 is arranged.

In FIG. 3, Vf represents voltage to be applied between the gate 5 and the cathode 6 of the element, If represents device current, which flows at that time, Va represents voltage to be applied between the cathode 6 and the anode 20, and Ie represents electron emission current. Herein, electron emission efficiency η is obtained in general by an equation of efficiency η=Ie/(If+Ie), using the current If detected when applying the voltage to the device and the current Ie taken out in a vacuum.

[Overview of Gate Deformation by Coulomb Force]

When the voltage Vf is applied to the device as illustrated in FIG. 3, positive or negative electric charge is generated on a bottom surface of the gate 5 (portion opposed to the concave portion 7) and the protrusion formed on the concave portion 7 of the cathode 6, across the concave portion 7. That is to say, Coulomb force by the electric charge is generated between the gate 5 and the cathode 6 opposed to each other with the concave portion 7 interposed therebetween as attracting force. Then, any of the gate 5 and the cathode 6 is deformed so as to be pulled to the other by the Coulomb force, so that the distance of the gap 8 becomes short. Assuming the voltage Vf does not change, electric field intensity in the gap 8 becomes large, so that more electric charge is generated in the gate 5 and the cathode 6. Then, the gate 5 or the cathode 6 is further deformed so as to be pulled to the other. That is to say, the positive feedback increases the deformation, and finally the gate 5 and the cathode 6 contact each other and the electron-emitting unit is broken.

Figure 4A:
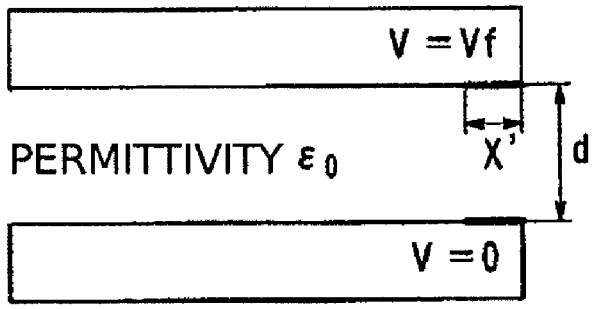
FIGS. 4A to 4C are views for illustrating gate deformation by Coulomb force according to the present invention.

This is described in more detail with reference to FIGS. 2, 4 and 5. First, the Coulomb force generated between the gate 5 and the cathode 6 is studied. FIG. 4A illustrates a model of the gate 5 and the cathode 6 in FIG. 2 simplified by parallel plates formed of a conductive body. In FIG. 4A, distance d [m] between the two parallel plates corresponds to the distance d [m] of the gap 8 between the gate 5 and the protrusion portion of the cathode 6 in FIG. 2, and X' [m] represents a range in which the Coulomb force expressed by a following equation (5) is generated. Herein, in the following description, assume that a cross-sectional shape illustrated in FIG. 4A is uniformly continued in the direction perpendicular to the paper surface.

When the voltage Vf (V) is applied between the parallel plates, the electric charge is generated on the surfaces of the parallel plate. The electric charge amount Q[C] is expressed as $$Q=\epsilon 0\times S/d \quad (1),$$

where S [$m^2$] is an area of the surface of the parallel plate and ϵ0 [F/m] is the vacuum permittivity.

The Coulomb force F [$kg\cdot m/s^2$] generated between the parallel plates by the electric charge amount Q expressed by the equation (1) is expressed by a following equation (2), $$\begin{aligned} F &= 0.5\times Q\times E \quad (2)\\ &= 0.5\times(\varepsilon 0\times S/d)\times Vf\times(Vf/d)\\ &= 0.5\times\varepsilon 0\times S\times(Vf/d)^2, \end{aligned}$$

where E [V/m] is the electric field intensity generated between the parallel plates.

[Coulomb Force Loading Area]

Figure 4B:
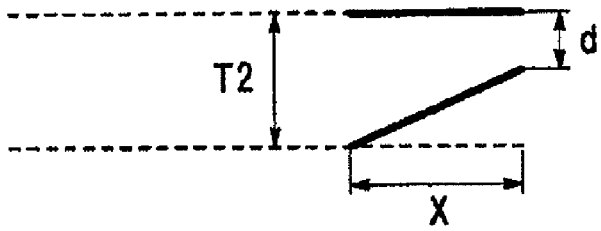

In the configuration of the electron-emitting device of the present invention, the distance between the gate 5 and the protrusion of the cathode 6 becomes larger inside thereof as illustrated in FIG. 2, although the distance between the two parallel plates is uniformly d in FIG. 4A. Considering this point, the Coulomb force generated in a schematic diagram as FIG. 4B is studied. FIG. 4B is a schematic diagram focusing on the distance between the gate 5 and the protrusion of the cathode 6. In FIG. 4B, the distance between the gate 5 and the cathode 6 is set to d on an outer surface of the gate 5 and set to a film thickness of the insulating layer 3*b* (thickness of a portion having the concave portion 7 of the insulating member 3) T2 [m] on a position with intruding distance X [m] of the cathode 6 into the concave portion 7. The Coulomb force generated in the configuration with distribution in the distance between the upper and lower two plates as illustrated in FIG. 4B is calculated.

In the equation (2), using infinitesimal area ΔS=Δx×b (b [m] is length in the direction perpendicular to the paper surface) and integrating over a range from 0 to X, the Coulomb force will be calculated as the following equation (3).

$$\begin{aligned} F1 &= \int_0^x 0.5\varepsilon 0 b\left(\frac{Vf}{y}\right)^2 dx,\ y = d+\left(\frac{T2-d}{x}\right)x \quad (3)\\ F1 &= 0.5\times\varepsilon 0\times b\times Vf^2\times(X/(d\times T2)). \end{aligned}$$

On the other hand, if the distance between the upper and lower two plates at uniformly d and the area S to which the Coulomb force is applied is equal to b×X', the Coulomb force will be calculated from the equation (2) as the follows, $$F2=0.5\times\epsilon 0\times b\times Vf^2\times(X'/d^2) \quad (4).$$

Let us consider replacing the configuration having the distribution in the distance between the upper and lower two plates as in FIG. 4B by the configuration in which the distance between the two plates is constantly d as illustrated in FIG. 4A. Assuming F1=F2, $$X'=(d\times X)/T2 \quad (5)$$

is obtained.

That is to say, the Coulomb force generated in the configuration of FIG. 4B is equivalent to the force in the configuration of FIG. 4A with the distance d being equal to X'.

The distance d is included in the equation of X' and thus the value of d changes as the Coulomb force generates the deformation. However, if suppose X' does not change during the deformation, X' can be expressed as:

$$X'=(d0\times X)/T2 \quad (6),$$

where d0 [m] is the distance d without voltage application.

Therefore, the Coulomb force F [$kg\cdot m/s^2$] per unit length in the direction perpendicular to the paper surface in FIG. 4A is represented as:

$$F=0.5\times\epsilon 0\times(d0\times X/T2)\times(Vf/d)^2 \quad (7).$$

Next, the deformation amount generated by the Coulomb force between the cathode 6 and the gate 5 is studied. Herein, assume that the gate 5 is deformed, and FIG. 4C illustrates a model of the gate 5 simplified by a cantilever.

Figure 4C:
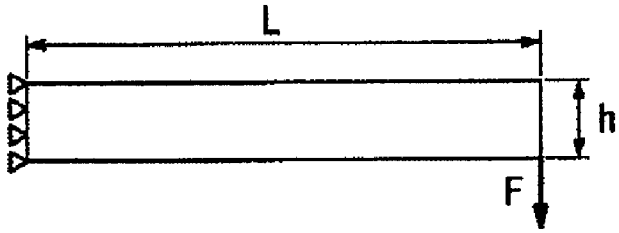

In FIG. 4C, length L [m] represents the distance from the outer surface of the gate 5 to the inner surface of the concave portion 7. Also, h [m] represents a film thickness of the gate 5. In the model of cantilever, the outer surface is a free end and the inner surface of the concave portion 7 is a fixed end. It is assumed that the cross-sectional shape is uniformly same as shown in FIG. 4C.

When the Coulomb force expressed by an equation (7) is generated as a load on the free end side of the cantilever in FIG. 4C, a deformation amount δ [m] generated on the free end side of the cantilever by the load F is expressed as $$\delta = F \times L^3/(3 \times Y \times I) \quad (8).$$

Herein, I [$m^4$] is second moment of inertia of the cantilever and Y [Pa] is a Young's modulus.

The second moment of inertia I per unit length in the direction perpendicular to the paper surface is $$I = h^3/12 \quad (9)$$

in consideration of a rectangular cross section. The equations (8) and (9) give:

$$\delta = 4 \times F \times L^3/(Y \times h^3) \quad (10).$$

The deformation amount δ can be expressed as $$\delta = d0 - d' \quad (10.5),$$

where d0 [m] is the gap distance between the gate 5 and the protrusion portion of the cathode 6 before the voltage application, and d' [m] is the gap distance after the gate 5 is deformed by the load F. Based on the equations (10) and (10.5), a relationship between the load F and the gap distance d' [m] after the deformation of the gate 5 is expressed as $$F = Y \times h^3/(4 \times L^3) \times (d0 - d') \quad (11).$$

Figure 5A:
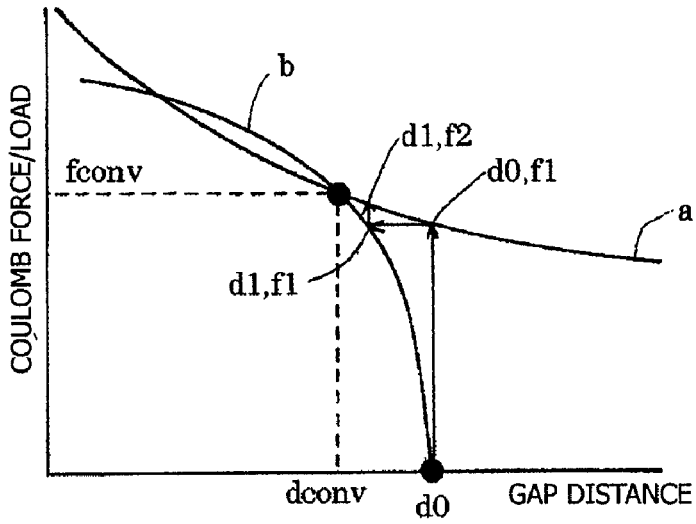
FIGS. 5A to 5C are views for illustrating relationship between the deformation of the gate and the Coulomb force/load according to the present invention.
Figure 5B:
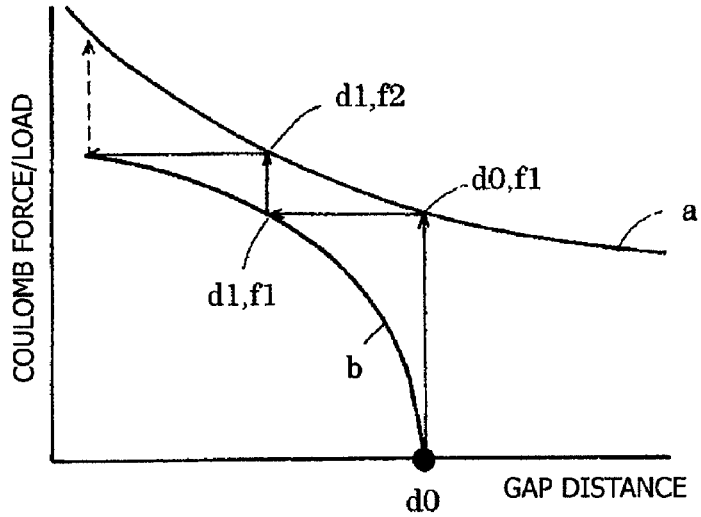
Figure 5C:
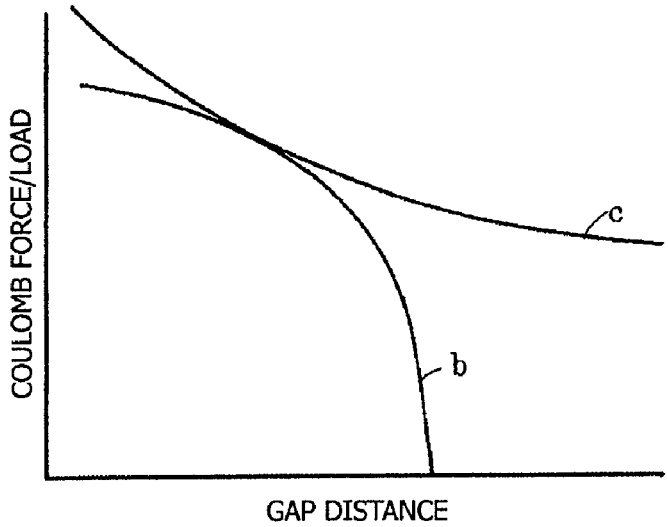

Next, relationship between the deformation and the Coulomb force/load is described with reference to FIGS. 5A to 5C. In FIGS. 5A to 5C, curve "a" represents the equation (7) with d along the abscissa and F along the ordinate and curve "b" represents the equation (11) with d' along the abscissa and F along the ordinate, the both of them are superimposed with the gap distance after the deformation d' along the abscissa and the Coulomb force/load along the ordinate. In FIGS. 5A-5C, the gap distance d in the gap distance versus Coulomb force curve "a" of the equation (7) is replaced with the gap distance d' after the deformation. Also, the gap distance before applying the voltage is set to d0.

First, we describe a case in which the deformation is converged. FIG. 5A illustrates a case in which the curve "a" of the equation (7) and the curve "b" of the equation (11) have an intersection. In FIG. 5A, the Coulomb force generated with the gap distance d0 before applying the voltage is f1. The cantilever is deformed by the load f1 and the gap distance becomes d1. The Coulomb force generated with the new gap distance d1 is f2. By repeating this, the gap distance and the load finally converge to dconv and fconv, respectively.

Next, we describe a case in which the deformation result in short-circuit between the gate 5 and the protrusion of the cathode 6. FIG. 5B illustrates a case in which the gap distance versus Coulomb force curve "a" and the load versus gap distance curve "b" do not have the intersection. Similarly, the Coulomb force with the gap distance d0 is f1, the cantilever is deformed by f1 and the gap distance becomes d1. By repeating this, the Coulomb force diverges to infinity and the gap distance converges to 0. The gap distance 0 means that the short-circuit occurs between the protrusion of the cathode 6 and the gate 5 and the electron-emitting device is broken.

Consequently, we can derive a condition required for preventing the electron-emitting device from being broken by the Coulomb force generated between the gate 5 and the protrusion of the Cathode 6. That is to say, as illustrated in FIG. 5A, the gap distance versus Coulomb force curve "a" expressed by the equation (7) and the load versus gap distance curve "b" expressed by the equation (11) should have an intersection.

[Parameter c1]

Figure 6A:
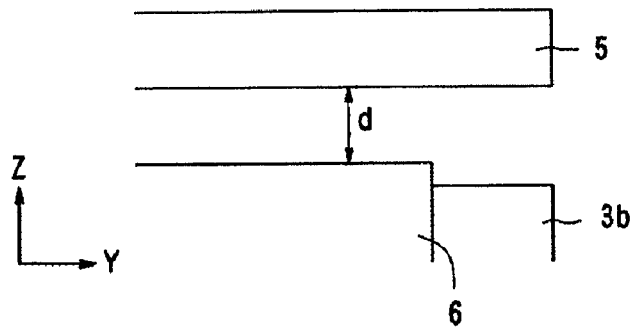
FIGS. 6A to 6C are views for illustrating a load coefficient c1 according to the present invention.
Figure 6B:
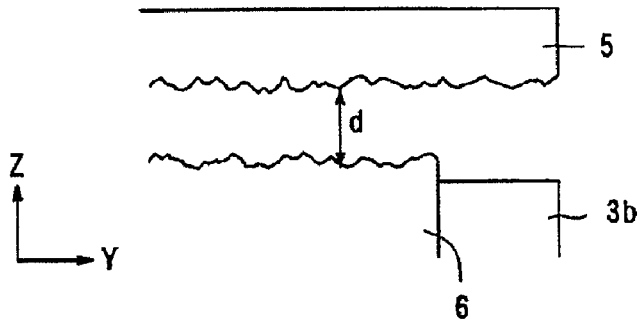
Figure 6C:
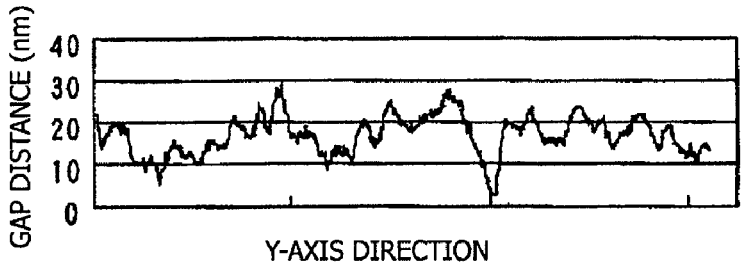

Next, a load coefficient c1 is described. The gap distance versus Coulomb force curve "a", or the equation (7) is calculated under the assumption that the gap distance d illustrated in FIG. 4A is uniformly continued in the direction perpendicular to the paper surface (FIG. 6A). However, since the gap distance d is of minute nanometer order, width is not completely uniform and the gap distance d fluctuates as illustrated in FIG. 6B in an actual electron-emitting device, and the gap distance is wide at some points and narrow at other points. FIG. 6C illustrates an example of the distribution of the gap distance d in a Y-axis direction in FIG. 6B. With reference to FIG. 6C, the narrowest gap distance was approximately 3 nm and the widest gap distance was approximately 30 nm, and an average thereof is 15 nm.

Two Coulomb forces F and F' are compared, where F is the Coulomb force generated in case the gap distance d is uniformly 3 nm in the Y-axis direction (FIG. 6A) and F' is the Coulomb force generated in case the gap distance fluctuates as illustrated in FIG. 6C (FIG. 6B). F' can be obtained by integrating the Coulomb force ΔF' in a infinitesimal section ΔY over the illustrated range, where ΔF' can be obtained by applying the Y-direction gap distance in the infinitesimal section ΔY to the equation (7). Then F'/F=0.0534 is obtained.

Figure 7:
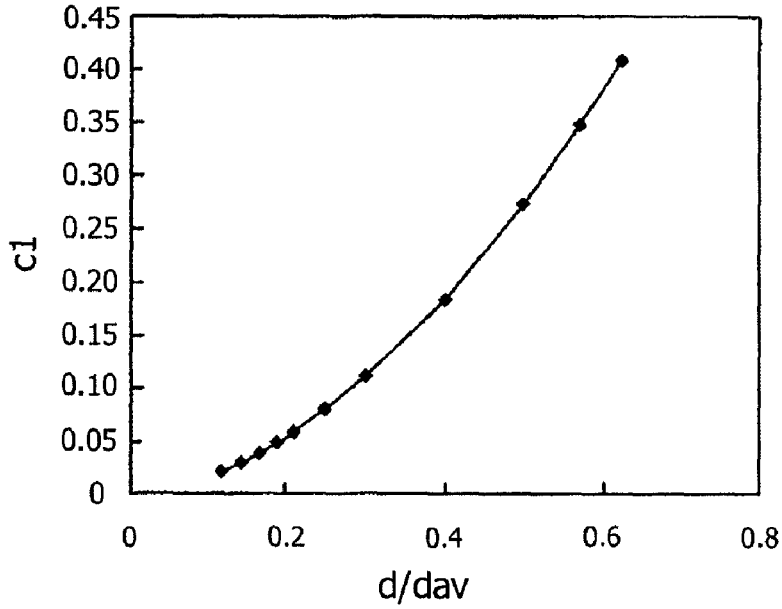
FIG. 7 is a view illustrating relationship between gap distance between the gate and a protrusion of a cathode and the load coefficient c1.

Similarly, in the example having another gap distance distribution also, the minimum value d of the gap distance, an average value dav of the gap distance and the Coulomb forces F and F' are calculated. FIG. 7 is a view in which the gap distance distributions are plotted with d/dav along the abscissa axis and c1=F'/F along the ordinate axis. By approximating the points plotted in FIG. 7, they may be expressed as an approximate equation of $$c1 = 0.94 \times (d/dav)^{1.78} \quad (12).$$

Applying c1 of the equation (12), the equation (7) may be rewritten as:

$$F' = 0.5 \times \epsilon 0 \times (d0 \times X/T2) \times c1 \times (Vf/d)^2 \quad (13).$$

[Condition to Inhibit Cantilever Feedback Runaway]

When the gap distance versus Coulomb force curve "c" expressed by the equation (13) and the load versus gap distance curve "b" expressed by the equation (11) have the intersection, the gap distance d' at the intersection satisfies the following equation (14). In the equation, d0 is the gap distance before applying the voltage.

Here, it is set that F' in the equation (13) is equal to F in the equation (11).

$$0.5 \times c1 \times \epsilon 0 \times (d0 \times X/T2) \times (Vf/d')^2 = Y \times h^3/(4 \times L^3) \times (d0 - d') \quad (14)$$

By arranging the equation (14), this may be expressed by a cubic equation of d' as an equation (15).

$$(Y \times h^3/(4 \times L^3)) \times d'^3 - (Y \times h^3/(4 \times L^3)) \times d0 \times d'^2 + 0.5 \times c1 \times \epsilon 0 \times (d0 \times X/T2) \times Vf^2 = 0 \quad (15)$$

When the two curves of the equations (13) and (11) are tangent to each other as illustrated in FIG. 5C, the equation (15) has a multiple root for d', and the condition for multiple root is expressed as $$L/h = (2 \times d0^3 \times Y/(27 \times c1 \times \epsilon 0 \times (d \times X/T2) \times Vf^2))^{1.0/3} \quad (16).$$

That is to say, when a ratio of L to h satisfies the relationship in the equation (16), the two curves, the gap distance versus Coulomb force curve "c" of the equation (13) and the load versus gap distance curve "b" of the equation (11) contact one another as illustrated in FIG. 5C. When the ratio of L to h is smaller than a value satisfying the equation (16), the two curves have the intersection as illustrated in FIG. 5A, on the other hand, when the ratio of L to h is larger than the value satisfying the equation (16), the two curves do not have the intersection as illustrated in FIG. 5B.

Therefore, the condition to avoid the breakdown of the electron-emitting unit due to the Coulomb force feedback runaway is $$L/h \leqq c2 \times (2 \times d0^3 \times Y/(27 \times c1 \times \epsilon 0 \times (d \times X/T2) \times Vf^2))^{1.0/3} \quad (17).$$

Here, c2 represents a safety factor not larger than 1.0. For example, when d=3 nm, c1=0.055, Vf=26 V, Y=155 GPa and X=10 nm, and when c2=1.0, the condition is L/h≦4.6. The gap distance d' at a conversion point is reduced by 0.9 nm to 2.1 nm, as compared with the gap distance before applying the voltage d0.

Figure 8:
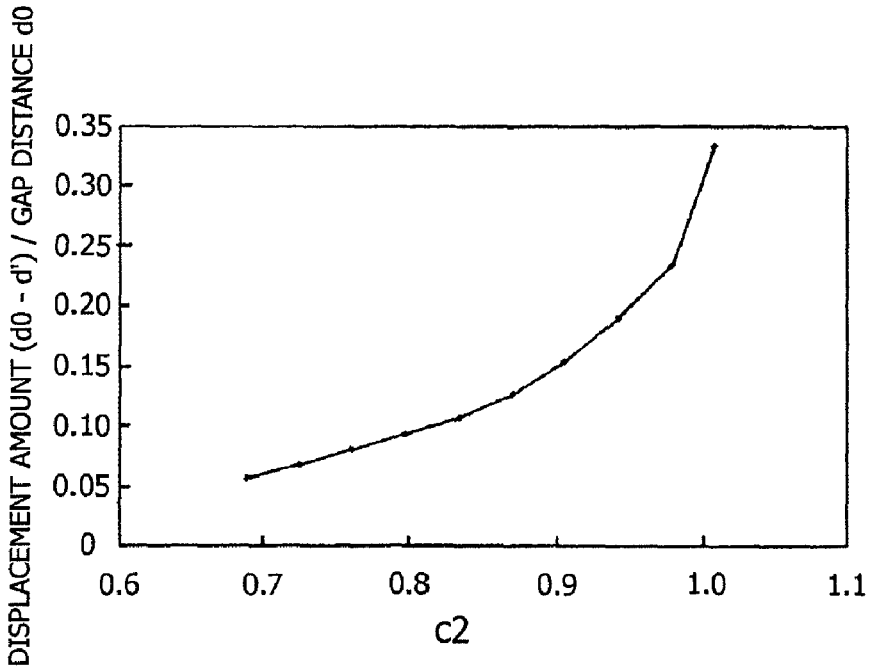
FIG. 8 is a view illustrating relationship between a displacement amount of the gate and a safety coefficient c2.

FIG. 8 is a view illustrating relationship between the coefficient c2 and the deformation amount by the Coulomb force, in which the abscissa represents coefficient c2 and the ordinate represents (d0−d')/d0. From FIG. 8, it is seen that c2≦0.8 is sufficient to restrict the deformation amount within approximately 10% of the gap distance d0 before applying the voltage.

From above, the condition to avoid the breakdown of the electron-emitting unit due to the Coulomb force feedback runaway, with the safety factor c2 being 0.8, can be obtained by replacing the distance d0 before applying the voltage to d in the equation (17), and is shown as the following equation (18).

$$L/h \leqq 0.8 \times (2 \times d^3 \times Y/(27 \times c1 \times \epsilon 0 \times (d \times X/T2) \times Vf^2))^{1.0/3} \quad (18)$$

[Lower Limit of L]

The upper limit of L for avoiding the breakdown of the electron-emitting unit due to the Coulomb force feedback runaway can be derived by multiplying h by both sides of the equation (18). At the same time, the value of L deeply relates to the leakage of the device, and the deeper the concave portion 7 is formed, the smaller the value of the leakage is. In addition, when the intruding distance X becomes larger than the length L, the leakage is more likely to occur. In order to keep the leakage small, we will discuss a condition that the intruding distance X of the cathode 6 into the concave portion 7 be smaller than the length L.

Figure 9A:
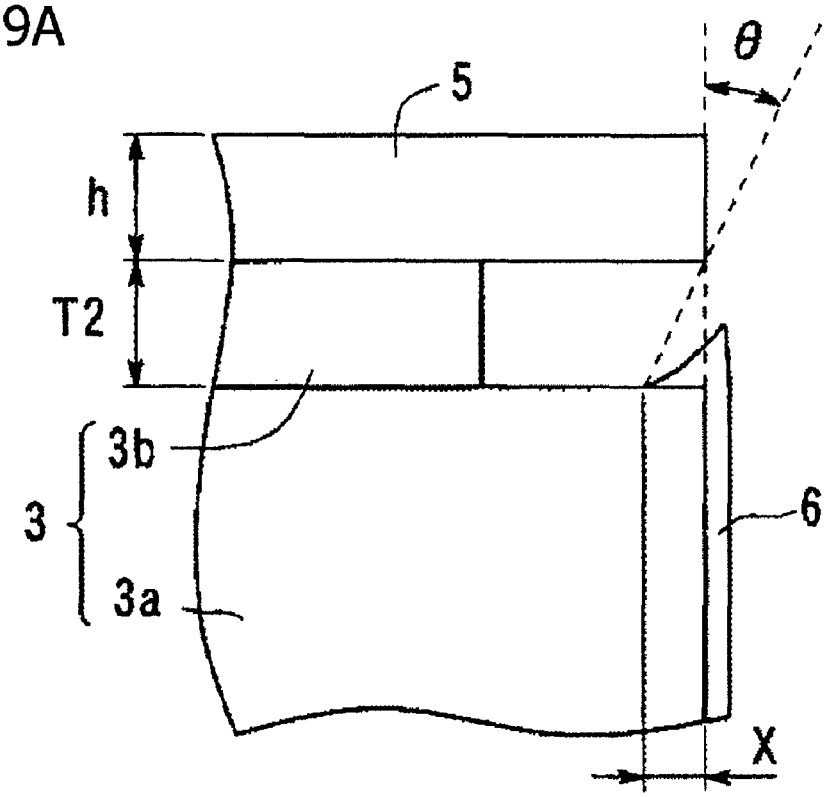
FIG. 9A is an enlarged schematic cross-sectional view of the vicinity of an electron emitting unit of the electron-emitting device according to the present invention and FIG. 9B is a view illustrating relationship between an incident angle and adhesion probability of a particle by a sputtering film forming method.

FIG. 9A is a schematic diagram focusing on the concave portion 7 and the cathode 6. T2 represents a thickness [m] of the insulating layer 3*b*. X represents an intruding distance [m] of the cathode 6 into the concave portion 7. Angle θ represents an angle between the vertical direction and a line connecting the tip end of the cathode 6 intruding into the concave portion 7 and an end of the gate.

Figure 9B:
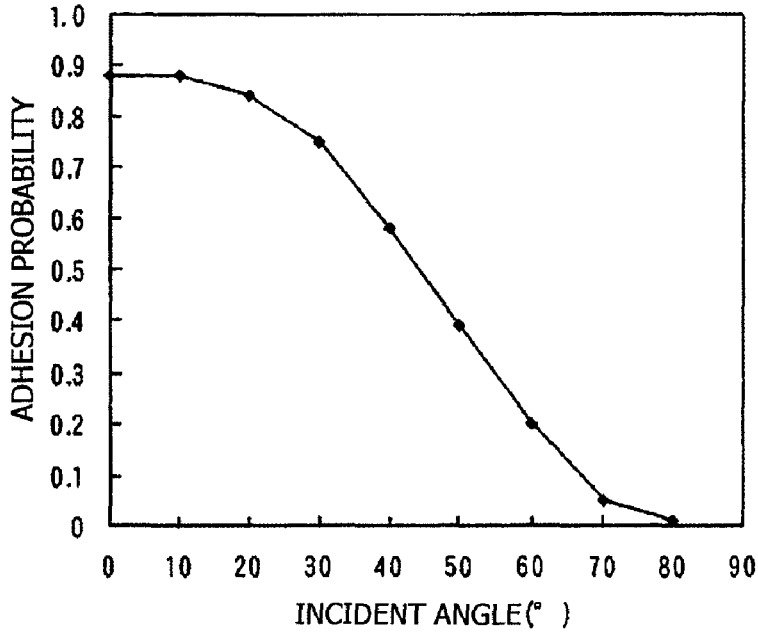

FIG. 9B illustrates relationship between an incident angle of a sputtered particle and adhesion probability in which the incident angle of the particle is represented along the abscissa. It is seen that the larger the incident angle is, the harder for the particle to adhere, and it is understood that the particle hardly sticks with the incident angle larger than 70°. That is to say, in FIG. 9A, it is sufficient to consider only a range of angle θ smaller than or equal to 70°. When θ=70°, since tan 70°=2.7, X=2.7×T2 is obtained.

From above, the lower limit of the distance L from the outer surface of the gate 5 to the inner surface of the concave portion 7 is:

$$2.7 \times T2 \leqq L \quad (19),$$

where T2 is the thickness of the insulating layer 3*b*.

[Wedge-Shaped Gate]

Figure 10:
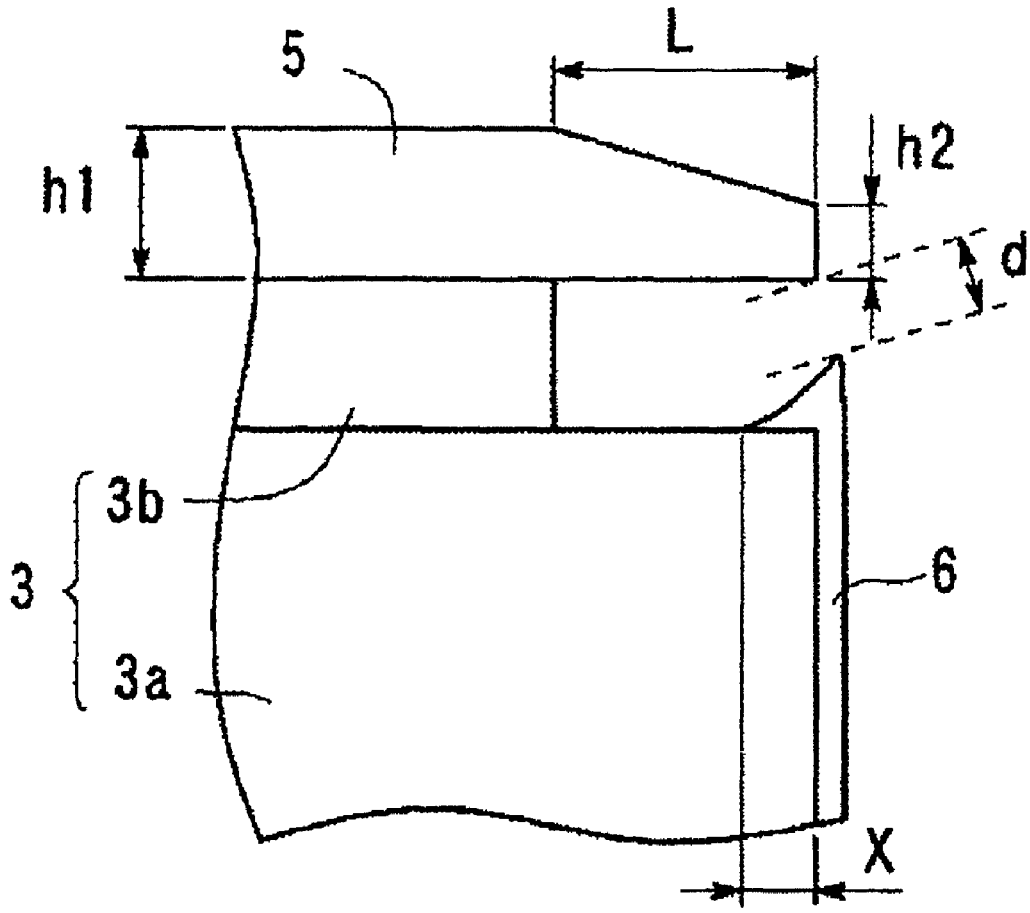
FIG. 10 is an enlarged schematic cross-sectional view of the vicinity of the concave portion of the electron-emitting device according to another embodiment of the present invention.

In the above description, we consider a simplified model in which the shape of the gate 5 is assumed rectangular as illustrated in FIG. 2. Now we consider a more elaborate model with a wedge-shaped cross section as shown in FIG. 10, in which the shape of the gate 5 becomes thinner toward the outer surface. In FIG. 10, h2 denotes a film thickness of the gate 5 on the outer surface and h1 denotes a film thickness on a position on the inner surface of the insulating layer 3*b*. The model also uses the cantilever configuration in which the side of thickness h1 is the fixed end and film the side of thickness h2 is the free end.

Figure 11A:
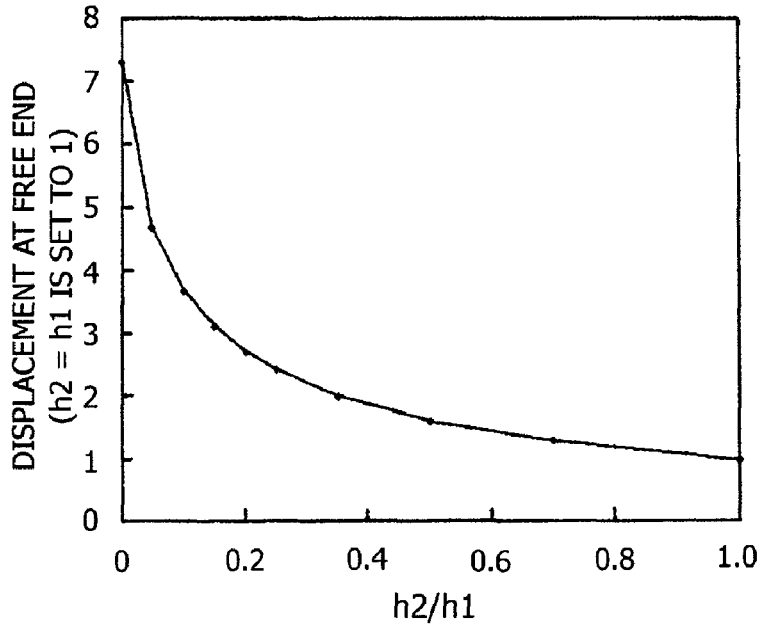
FIGS. 11A and 11B are views illustrating relationship between a film thickness ratio between a fixed end side and a free end side of the gate and displacement on the free end side, and relationship between the film thickness ratio and equivalent film thickness of the gate, respectively.

The displacement amount of the cantilever at the free end when loading the load in the area of the distance X is calculated by numerical simulation of the shape in FIG. 10, with L=100 nm, X=10 nm, h1=20 nm and h2=0 to 20 nm. In FIG. 11A, h2/h1 is represented along the abscissa, and the displacement at the free end is normalized such that the value is set to one when h1=h2=20 nm and represented along the ordinate.

Here, let us consider replacing the wedge-shaped cross section model of gate thicknesses h1 and h2 with equivalent rectangular cross section model having constant gate thickness h'. In the cantilever having the rectangular cross section, the displacement amount at the free end when the load F is applied to the free end is in inverse proportion to a cube of the gate film thickness as expressed by the equation (10).

$$\delta \propto 1/h^3 \quad (20)$$

Rewriting the equation (20), we obtain $$h' \propto (1/\delta)^{1.0/3} \quad (21)$$

Figure 11B:
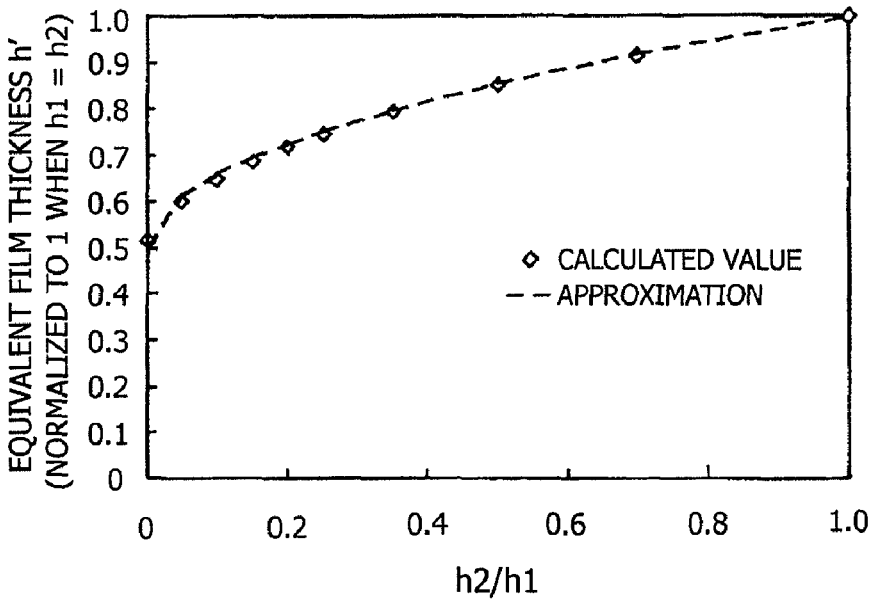

Based on the equation (21), h' is in proportion to a cubic root of an inverse number of the displacement at the free end. In FIG. 11B, h2/h1 is represented along the abscissa and the equivalent film thickness h' is represented along the ordinate. A value of h' is the cubic root of the inverse number of the value in FIG. 11A according to the equation (21) and is normalized such that h'=1 when h2/h1=1. An approximate curve of the value represented in FIG. 11B may be expressed as $$h' = 0.5 + 0.5 \times (h2/h1)^{0.5}.$$

Therefore, the gate film thickness h' having the rectangular shape equivalent to the wedge-shaped gate in the load versus gap distance relationship is expressed as $$h' = h1 \times (0.5 + 0.5 \times (h2/h1)^{0.5}) \quad (22).$$

From above, the condition to avoid the breakdown of the electron emitting unit due to the Coulomb force feedback runaway in the wedge-shaped gate model may be derived using the equation (18) for the gate having the rectangular shape and h' in the equation (22) and is expressed by the following equation (23).

$$L/h' \leqq 0.8 \times (2 \times d^3 \times Y/(27 \times c1 \times \epsilon 0 \times (d \times X/T2) \times Vf^2))^{1.0/3} \quad (23)$$

[Method of Manufacturing]

An exemplary method of manufacturing the electron-emitting device illustrated in FIG. 1 is described with reference to FIG. 12.

The substrate 1 is to mechanically support the device and is made of, for example, silica glass, glass of which impurity contents such as Na are reduced, soda-lime glass or silicon substrate. As for functions required for the substrate, not only high mechanical strength is preferable but also resistance to dry etching, wet etching and alkali and acid such as developer is preferable. Further, it is preferable that difference in thermal expansion between the substrate itself and film forming materials or other laminated members be small if the substrate is used as integral structure such as a display panel. In addition, such material is desirable that alkali element and the like from inside the glass does not easily diffuse during the heat treatment.

Figure 12A:
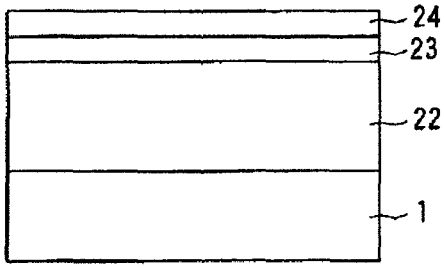
FIGS. 12A to 12G are views illustrating an example of a manufacturing process of the electron-emitting device according to the present invention.

First, as illustrated in FIG. 12A, insulating layers 22 and 23 and a conductive layer 24 are laminated as preparation for forming a step on the substrate. The insulating layers 22 and 23 are made of a material excellent in processability such as SiN ($Si_xN_y$) or $SiO_2$, for example, formed by means of a general vacuum film forming method such as sputtering, a CVD method and a vacuum deposition method. Thickness of the insulating layer 22 is set to a range from a few nm to tens of μm, preferably within a range of tens of nm to hundreds of nm. Thickness of the insulating layer 23 is set to a range from a few nm to hundreds of nm, preferably within a range of a few nm to tens of nm. Meanwhile, it is required to form the concave portion 7 after laminating the insulating layers 22 and 23, so that the insulating layers 22 and 23 should have different etching rates. The ratio of the etching rates of the insulating layer 23 to that of the insulating layer 22 is desirably equal to or larger than 10 and is desirably equal to or larger than 50 if possible. For example, the insulation layer 22 may be composed of $Si_xN_y$ and the insulating layer 23 may be composed of an insulating material such as $SiO_2$ or PSG film having high phosphorous concentration or a BSG film having high boron concentration and the like.

The conductive layer 24 is formed by means of general vacuum film forming technique such as the deposition method and the sputtering. A material of the conductive layer 24 desirably should have high thermal conductivity in addition to the conductivity and its fusing point should be high. For example, metal such as Be, Mg, Ti, Zr, Hf, V, Nb, Ta, Mo, W, Al, Cu, Ni, Cr, Au, Pt and Pd or an alloy material may be used. In addition, carbide such as TiC, ZrC, HfC, TaC, SiC and WC, boride such as $HfB_2$, $ZrB_2$, $CeB_6$, $YB_4$ and $GdB_4$, nitride such as TiN, ZrN, HfN and TaN and semiconductors such as Si and Ge may be used. Further, carbon or carbon compound derived from decomposition of an organic polymeric material, amorphous carbon, graphite, diamond-like carbon and diamond may be appropriately used. Thickness of the conductive layer 24 is set in a range from a few nm to hundreds of nm, preferably within a range from tens of nm to hundreds of nm. In addition, in order to inhibit the deformation of the gate 5 due to the Coulomb force when applying the voltage, it is required that the ratio between the depth of the concave portion 7 and the film thickness of the gate 5 is included in the range described in the present invention.

Figure 12B:
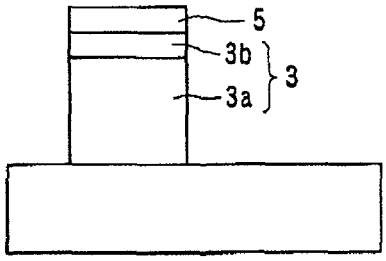

After forming a resist pattern on the conductive layer 24 by means of photolithography technique, the conductive layer 24 and the insulating layers 23 and 22 are sequentially processed using an etching method to obtain the gate 5 and the insulating layers 3*b* and 3*a* as illustrated in FIG. 12B. In such an etching process, reactive ion etching (RIE) capable of precisely etching the material by converting etching gas into plasma and applying the same to the material is generally used. As processing gas at that time, fluorine gas such as $CF_4$, $CHF_3$ and $SF_6$ is selected in case of forming fluoride as an object member to be processed. In addition, in case of forming chloride to etch Si, Al or the like, chlorine gas such as $Cl_2$ and $BCl_3$ is selected. Also, hydrogen, oxygen, argon gas and the like may be added as needed, in order to obtain a selection ratio with the resist, and in order to secure smoothness of an etching surface or to increase an etching speed.

Figure 12C:
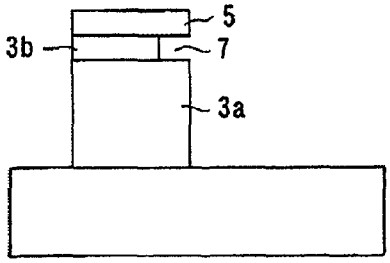

As illustrated in FIG. 12C, the concave portion 7 is formed on the surface of the insulating member 3 composed of the insulating layers 3*a* and 3*b* by etching the insulating layer 3*b*. In this etching, mixed solution of ammonium fluoride and hydrofluoric acid generally referred to as buffered hydrofluoric acid (BHF) may be used when the insulating layer 3*b* is the material formed of $SiO_2$, for example, and hot phosphoric type etching solution may be used when the insulating layer 3*b* is a material formed of $Si_xN_y$. The depth of the concave portion 7 (distance from the outer surface of the insulating member 3 (side surface of the insulating layer 3*a*) to a side surface of the insulating layer 3*b*)) deeply relates to the leakage of the element, and the deeper the concave portion 7 is formed, the smaller the value of the leakage is. However, when this is too deep, a problem such as the deformation of the gate occurs. Therefore, the distance is set to approximately 30 nm to 200 nm. In addition, in order to inhibit the deformation of the gate 5 by the Coulomb force when applying the voltage, it is required that the ratio of the depth of the concave portion 7 to the film thickness of the gate 5 is included in the range described in the present invention.

Figure 12D:
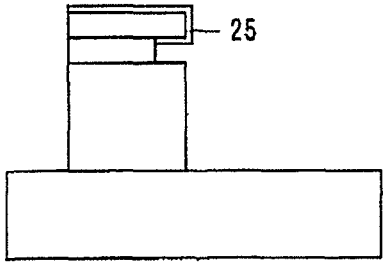

As illustrated in FIG. 12D, a release layer 25 is formed on the gate 5. The release layer 25 is formed in order to release the cathode material 26 deposited in a next process from the gate 5. To such an object, the release layer 25 is formed by means of oxidizing the gate 5 to form an oxide film, or by means of electrolytic plating the gate 5 to attach releasing metal, for example.

Figure 12E:
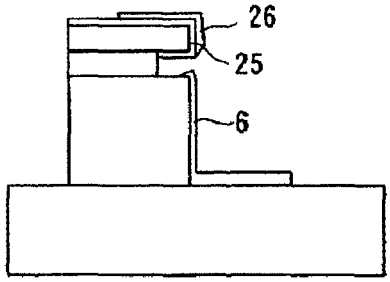

As illustrated in FIG. 12E, the cathode material 26 is attached to the gate 5 and a part of the outer surface of the insulating member 3 (on the outer surface (side surface) of the insulating layer 3*a*) and on the inner surface of the concave portion 7 (upper surface of the insulating layer 3*a*)). The cathode material 26 may be a material having conductivity and performing field emission, and is generally the material with high fusing point not lower than 2000° C. and having work function not larger than 5 eV, and is preferably the material in which a chemical reaction layer such as oxide is hardly formed or the reaction layer may be easily removed. As such a material, metals or alloys of elements such as Hf, V, Nb, Ta, Mo, W, Au, Pt and Pd may be used, for example. Also, the carbide such as TiC, ZrC, HfC, TaC, SiC and WC, the boride such as $HfB_2$, $ZrB_2$, $CeB_6$, $YB_4$ and $GdB_4$, and the nitride such as TiN, ZrN, HfN and TaN may be used. Further, carbon or carbon compound derived from decomposition of amorphous carbon, graphite, diamond-like carbon, or diamond may be used. The cathode material 26 is formed by means of the general vacuum film forming technique such as the deposition method and the sputtering.

As described above, in the present invention, it is required to make the protrusion of the cathode 6 by controlling an angle of deposition, film formation time, a temperature when forming and a degree of vacuum when forming such that this has the optimal shape for efficiently taking out the electron. Specifically, an intruding amount X of the cathode material 26 into an upper surface of the insulating layer 3*a*, which becomes the inner surface of the concave portion 7, is 10 nm to 30 nm, further preferably 20 nm to 30 nm. Also, an angle (θ in FIG. 2) between the upper surface of the insulating layer 3*a*, which becomes the inner surface of the concave portion 7 of the insulating material 3, and the cathode 6 is preferred to be equal to or greater than 90°.

Figure 12F:
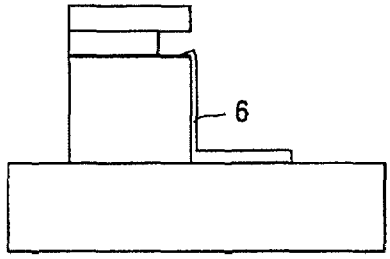
Figure 12G:
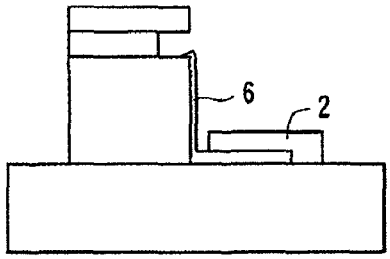

As illustrated in FIG. 12F, the release layer 25 is removed by means of etching, so that the cathode material 26 on the gate 5 is removed. Next, as illustrated in FIG. 12G, the electrode 2 is formed to make electrical contact with the cathode 6. The electrode 2 has conductivity as the cathode 6 and is formed by the general vacuum film forming technique such as the deposition method and the sputtering and the photolithography technique. As a material of the electrode 2, metals or alloy material such as Be, Mg, Ti, Zr, Hf, V, Nb, Ta, Mo, W, Al, Cu, Ni, Cr, Au, Pt and Pd may be used, for example. Also, the carbide such as TiC, ZrC, HfC, TaC, SiC and WC, the boride such as $HfB_2$, $ZrB_2$, $CeB_6$, $YB_4$ and $GdB_4$, and the nitride such as TiN, ZrN and HfN may be used. Further, the semiconductors such as Si and Ge, carbon or carbon compound derived from decomposition of organic polymeric material, amorphous carbon, graphite, diamond-like carbon, or diamond may be used. Thickness of the electrode 2 is set in a range from tens of nm to a few mm and, preferably within a range from tens of nm to a few μm.

The electrode 2 and the gate 5 may be formed of the same material or the different materials, and may be formed by the same method of forming or different methods of forming; however, the film thickness of the gate 5 is sometimes set thinner than that of the electrode 2, so that a low resistance material is desired.

Hereinafter, an image display apparatus provided with an electron source obtained by arranging a plurality of electron-emitting devices according to the present invention is described with reference to FIG. 21.

Figure 21:
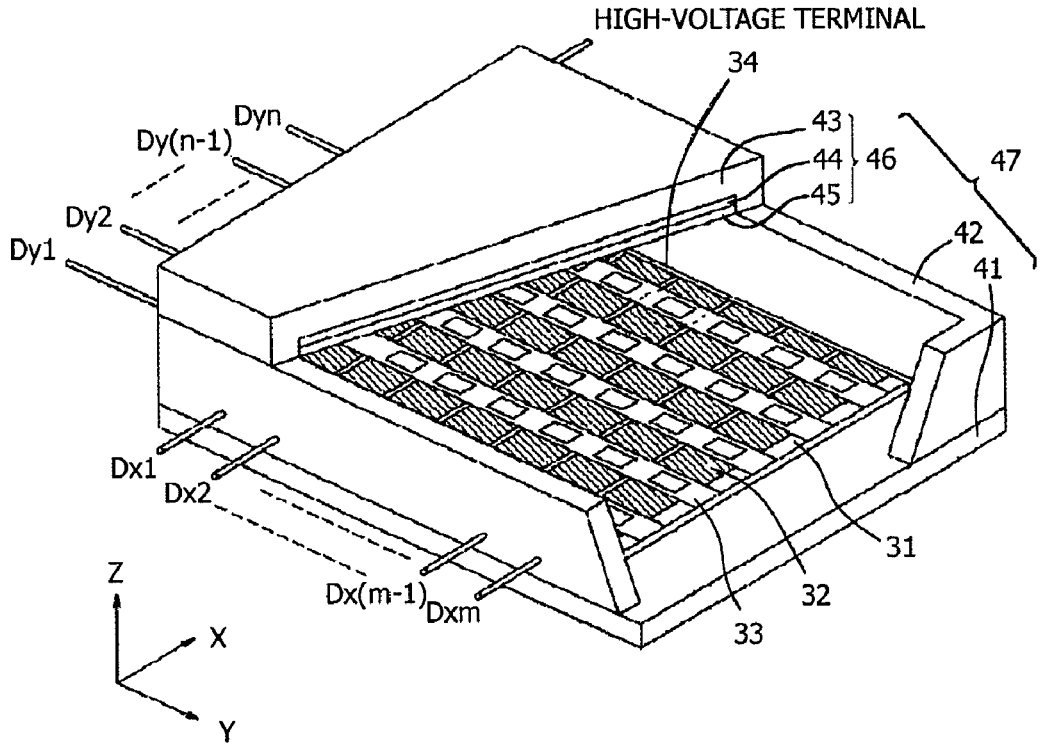
FIG. 21 is a perspective view illustrating a configuration of a display panel according to one embodiment of the present invention.

FIG. 21 is a schematic partially cutaway diagram of one example of a display panel of the image display apparatus composed by using the electron source of simple matrix arrangement.

In FIG. 21, reference numerals 31, 32 and 33 represent an electron source substrate, X-direction wirings and Y-direction wirings, respectively, and the electron source substrate 31 corresponds to the above-described substrate 1 of the electron-emitting device. Also, a reference numeral 34 represents the electron-emitting device according to the present invention. Meanwhile, the X-direction wirings 32 are the wirings that connect the above-described electrode 2 in common and the Y-direction wirings 33 are the wiring that connect the above-described gate 5 in common.

M lines, Dx1, Dx2, . . . and Dxm, of X-direct ion wirings 32 are provided and each of which may be composed of conductive metal and the like formed by using the vacuum deposition method, printing, the sputtering and the like. A material, a film thickness and width of the wirings are appropriately designed. N lines, Dy1, Dy2, . . . and Dyn, of Y-direction wirings 33 are provided and each of which are formed in a similar manner as the X-direction wirings 32. An interlayer insulating layer not illustrated is provided between the m X-direction wirings 32 and the n Y-direction wirings 33 to electrically separate them (m and n are positive integrals).

The interlayer insulating layer not illustrated is composed of $SiO_2$ and the like formed by using the vacuum deposition method, the printing, the sputtering and the like. The interlayer insulating layer is formed into appropriated shape on an entire surface or a part of the electron source substrate 31 with X-direction wirings 32 provided thereon. The film thickness, the material and a method of manufacturing, in particular, are appropriately chosen so as to resist difference in electric potential at intersections of the X-direction wirings 32 and the Y-direction wirings 33. The X-direction wirings 32 and the Y-direction wirings 33 are drawn out as outer terminals. The electrode 2 and the gate 5 (FIG. 1) are electrically connected by the m X-direction wirings 32, the n Y-direction wirings 33 and wire connection formed of the conductive metal and the like. A part of or an entire constituent materials of the material to form the wirings 32 and the wirings 33, the material to form the wire connection and the material to form the electrode 2 and the gate 5 may be the same with or different to each other.

Scan signal applying means, not illustrated, is connected to the X-direct ion wirings 32 to apply a scan signal for selecting a row of the electron-emitting devices 34 arranged in the X-direction. In addition, hand, modulation signal generating means, not illustrated, is connected to the Y-direction wirings 33 to apply modulation signal to each column of the electron-emitting devices 34 arranged in the Y-direction according to an input signal. Driving voltage to be applied to each electron-emitting device is supplied as differential voltage between the scan signal and the modulation signal to be applied to the element.

In the above-described configuration, each device may be individually selected and driven using simple matrix wiring.

In FIG. 21, reference numeral 41 represents a rear plate, to which the electron source substrate 31 is fixed. And reference numeral 46 represents a face plate, which comprises a glass substrate 43, a fluorescent film 44, which is a phosphor serving as a light-emitting member, provided on the inner surface of the glass substrate, a metal back 45 serving as the anode 20, and the like. In addition, a reference numeral 42 represents a supporting frame, and the rear plate 41 and the face plate 46 are attached to the supporting frame 42 through frit glass and the like, composing an enclosure 47. Glass frit sealing is performed by baking the same for 10 minutes or longer in atmosphere or in nitrogen at a temperature range of 400 to 500° C.

The enclosure 47 is composed of the face plate 46, the supporting frame 42 and the rear plate 41 as described above. Here, the rear plate 41 is provided principally for the purpose of reinforcing the strength of the electron source substrate 31, and if the electron source substrate 31 itself has sufficient strength, a separate rear plate 41 is not required.

That is to say, it is possible that the supporting frame 42 is directly sealed to the electron source substrate 31 and the enclosure 47 may be composed of the face plate 46, the supporting frame 42 and the electron source substrate 31. On the other hand, by providing a supporting material not illustrated referred to as a spacer between the face plate 46 and the rear plate 41, the configuration with the sufficient strength with respect to atmosphere pressure may be obtained.

In such image display apparatus, the phosphor is aligned to be arranged on an upper portion of each electron-emitting device 34 in consideration of an orbit of the emitted electron. When the fluorescent film 44 in FIG. 21 is a colored fluorescent film, this may be composed of a black conductive material referred to as black strip or black matrix according to the alignment of the phosphor and the phosphor.

Next, a configuration example of a driving circuit for performing television display based on an NTSC television signal on the display panel composed by using the electron source of the simple matrix arrangement is described.

The display panel is connected to an external electric circuit through the terminals Dx1 to Dxm, the terminals Dy1 to Dyn and a high-voltage terminal. The scan signal for sequentially driving the electron source, which is a group of electron-emitting devices wired in a matrix pattern of m rows and n columns provided in the display panel, one line (N elements) by one line is applied to the terminals Dx1 to Dxm. On the other hand, the modulation signal for controlling an output electron beam of each element of the electron-emitting devices of one row selected by the scan signal is applied to the terminals Dy1 to Dyn. Direct-current voltage of 10 [kv], for example, is supplied from a direct current voltage source to the high-voltage terminal, and this is acceleration voltage for providing sufficient energy for energizing the phosphor to the electron beam emitted from the electron-emitting device.

As described above, the image display apparatus is realized by accelerating the emitted electron to apply to the phosphor by applying the scan signal and the modulation signal and by applying the high voltage to the anode.

Meanwhile, by forming such image display apparatus using the electron-emitting device of the present invention, the image display apparatus having an arranged shape of the electron beam may be configured, and as a result, the image display apparatus of which display properties are excellent may be provided.

EXAMPLE

First Example

Figure 13:
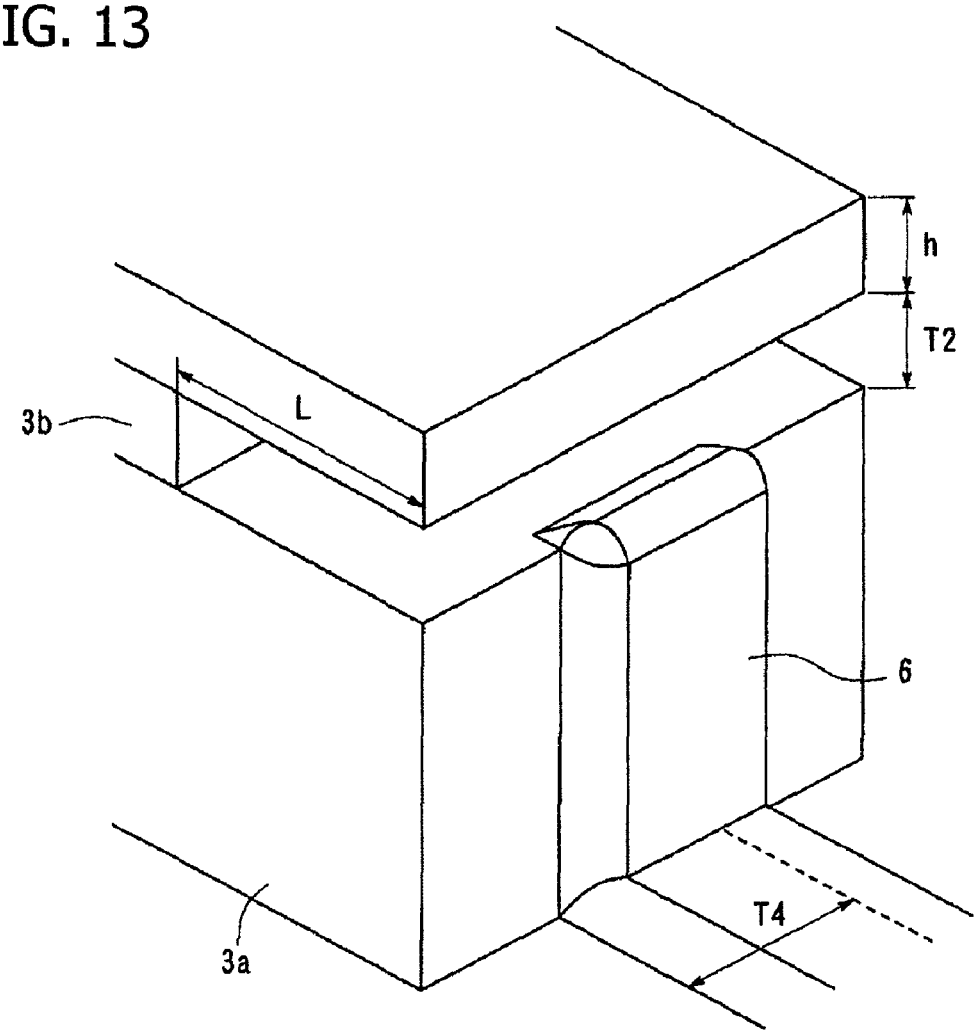
FIG. 13 is a perspective view of an example of the electron-emitting device according to the present invention.

The electron-emitting device having the configuration illustrated in FIG. 1 was manufactured according to the process in FIGS. 12A to 12G. FIG. 13 is a perspective view thereof.

First, as illustrated in FIG. 12A, PD200 made of low-sodium glass was used as the substrate 1, a 500 nm-thick SiN ($Si_xN_y$) film was formed by the sputtering as the insulating layer 22, then a 23 nm-thick $SiO_2$ film was formed by the sputtering as the insulating layer 23. Further, a 30 nm-thick TaN film was formed by the sputtering as the conductive layer 24 on the insulting layer 23.

Next, after forming the resist pattern on the conductive layer 24 by the photolithography technique, the conductive layer 24 and the insulating layers 23 and 22 were sequentially processed by using the dry etching method, and the insulating member 3 composed of the insulating layers 3*a* and 3*b* and the gate 5 were formed as illustrated in FIG. 12B. Since the material to form fluoride was selected in the insulating layers 22 and 23 and the conductive layer 24 as described above, $CF_4$-based gas was used as the processing gas in this instance. As a result of the RIE using the gas, the insulating layers 3*a* and 3*b* and the gate 5 after etching were formed with an angle of approximately 80° with respect to a horizontal surface of the substrate.

After releasing the resist, the insulating layer 3*b* was etched to have the depth of approximately 150 nm using the BHF to form the concave portion 7 on the insulating member 3 composed of the insulating layers Next, Ni was electrolytically deposited on the surface of the gate 5 by electrolytic plating to form the release layer 25, as illustrated in FIG. 12D.

As illustrated in FIG. 12E, molybdenum (Mo) being the cathode material 26 was attached on the outer surface of the insulating member 3 and the inner surface of the concave portion 7 (upper surface of the insulating layer 3*a*) to form the cathode 6. Meanwhile, at that time, the cathode material 26 was attached also on the gate 5. In this example, an EB deposition method was used as the film forming method. In this forming method, the angle of the substrate with respect to the horizontal surface of the substrate was set to 60° such that the cathode material 26 intrudes into the concave portion 7 by approximately 40 nm. According to this, it was set such that Mo enters the upper portion of the gate 5 at an angle of 60° and enters the outer surface after the RIE process of the insulating layer 3*a* being apart of the insulating member 3 forming the step at an incident angle of 40°. A rate of deposition was set to approximately 12 nm/min. Then, by precisely controlling deposition time (2.5 minutes in this example), it was formed such that the thickness of Mo on the outer surface of the insulating member 3 was 30 nm and the intruding amount (X) of the cathode material 26 into the concave portion 7 was 40 nm. Also, it was set that the angle between the inner surface of the concave portion 7 (upper surface of the insulating layer 3*a*) and the protrusion of the cathode 6, which becomes the electron emitting unit, was 120°.

After forming the Mo film, the Mo material 26 on the gate was released from the gate 5 by removing a Ni release layer 25 deposited on the gate 5 using the etching solution composed of iodine and potassium iodine. After the release, the resist pattern was formed by the photolithography technique such that width T4 of the cathode 6 (FIG. 13) was 100 μm. After that, the cathode 6 formed of molybdenum was processed using the dry etching method. The $CF_4$-based gas was used as the processing gas at that time because molybdenum used as the conductive layer material made fluoride (FIG. 12F). According to this, the cathode 6 in a strip shape having the protrusion located along the edge of the concave portion 7 of the insulating member 3 was formed. In this embodiment, the width of the cathode 6 conforms to the width of the protrusion, so that T4 may be said to be the width of the protrusion. Meanwhile, the width of the protrusion is intended to mean length in a direction along the edge of the concave portion 7 of the insulating member 3 of the protrusion.

As a result of analysis by cross-sectional TEM and frontal SEM, the distance d of the gap 8 between the protrusion portion of the cathode 6, which is the emitting unit, and the gate 5 in FIG. 2 was 3 nm at the minimum and an average value thereof was 15 nm.

Next, as illustrated in FIG. 12G, a copper (Cu) film having the thickness of 500 nm was laminated by the sputtering to form the electrode 2.

Figure 14:
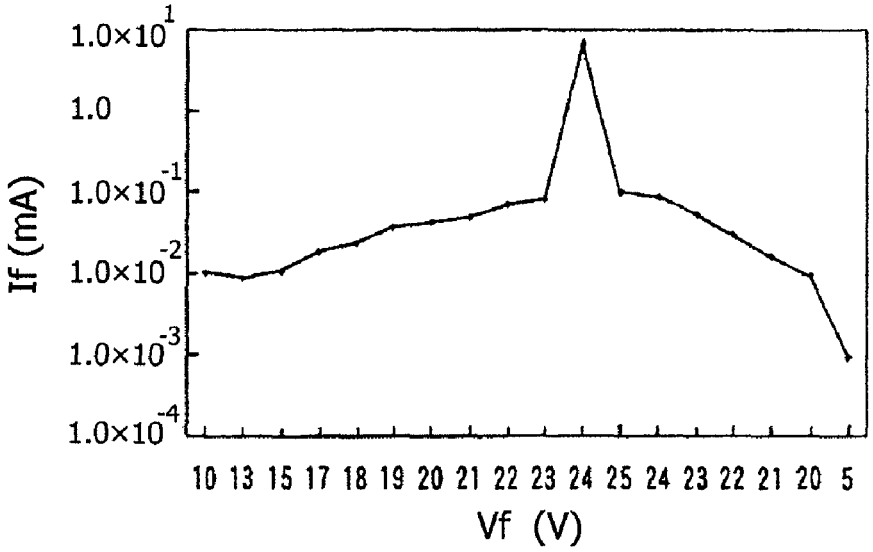
FIG. 14 is a view illustrating relationship between applied voltage and device current of the electron-emitting device of a first example of the present invention.

After forming the electron-emitting device in the above-described manner, properties of the electron source were evaluated by the configuration illustrated in FIG. 3. An evaluation result is illustrated in FIG. 14. In FIG. 14, Vf and If are represented along the abscissa and the ordinate, respectively, and a value of If relative to each Vf when gradually increasing Vf from 10V to 26V and thereafter gradually decreasing the same to 5V was represented. With reference to FIG. 14, it is understood that large current is suddenly generated when Vf is increased to 24V and the current significantly lowers when Vf is further increased. As a reason of sudden generation of the large current when Vf is increased to a certain value, it is considered that the above-described Coulomb force feedback runaway occurs to deform the gate 5, the gate 5 contacts the cathode 6, and the leak current is increased. As a reason of disappearance of the large current when Vf is further increased thereafter, it is considered that the contact portion of the gate 5 and the cathode 6 is broken by the large current and the leak current is decreased.

In this example, L=150 nm and h=30 nm, thus L/h=150/30=5. On the other hand, the condition for avoiding breakdown due to the Coulomb force feedback runaway can be obtained by applying the configuration in this example, the Young's modulus Y of the gate 5 (TaN) is equal to 155 GPa, X=40 nm, T2=20 nm, d=3 nm and dav=15 nm, to the equations (12) and (18). The condition is $$L/h \leqq 4.5 \quad (24),$$

at Vf=24V. It is indicated that the Coulomb force feedback runaway occurs when Vf=24V since the equation (24) is not satisfied.

Second Example

Figure 15:
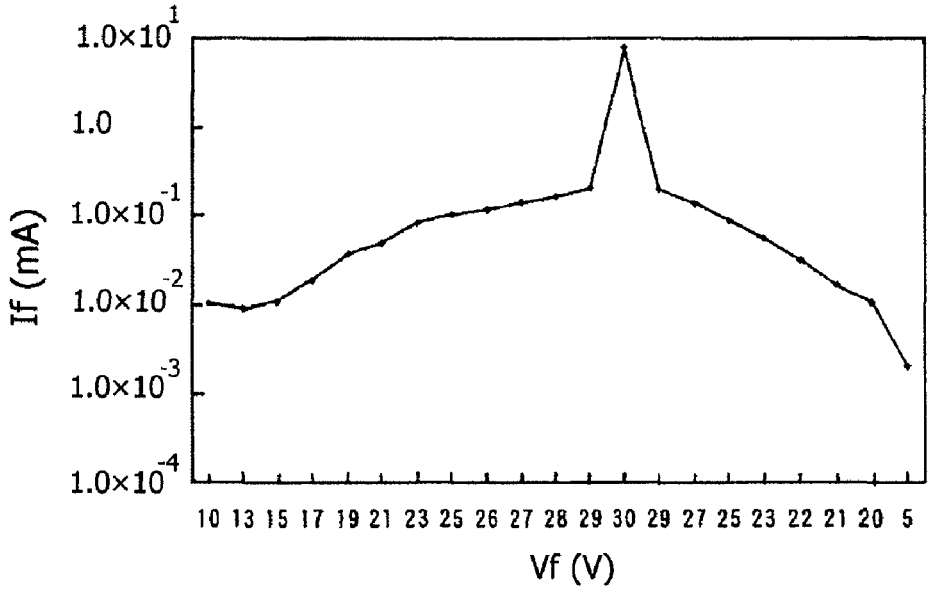
FIG. 15 is a view illustrating relationship between applied voltage and device current of the electron-emitting device of a second example of the present invention.

Next, the electron-emitting device was manufactured in which etching depth of the insulating layer 3*b* (depth of the concave portion 7) was made shallower than that of the first example, and an effect thereof was studied. Although the made device was similar to that of the first example, the etching depth when forming the concave portion 7 by etching the insulating layer 3*b* was set to 120 nm. As a result of the analysis by the cross-sectional TEM and the frontal SEM, the distance d of the gap 8 between the protrusion of the cathode 6 being the emitting unit and the gate 5 in FIG. 2 was 3 nm at the minimum and the average value thereof was 14.8 nm. When performing the property evaluation similar to that in the first example using the electron-emitting device thus obtained, as illustrated in FIG. 15, the sudden large current was generated when Vf=30 V.

In table 1, the configuration of the element, presence or absence of the large current generation, and a value of the upper limit of L/h in the equation (18) in the first and second example and third to fifth examples to be described hereinafter are arranged.

TABLE 1

| | L [nm] | h [nm] | L/h | Y [GPa] | d [nm] | dav [nm] | Vf | Presence of Large Current | Upper Limit of L/h defined by Equation (13) |
|---|---|---|---|---|---|---|---|---|---|
| Example 1 | 150 | 30 | 5.00 | 155 | 3 | 15.0 | 24 | PRESENT | 4.5 |
| Example 2 | 120 | 30 | 4.00 | 155 | 3 | 14.8 | 24 | — | 4.5 |
| | | | | | | | 30 | PRESENT | 3.9 |
| Exmaple 3 | 150 | 35 | 4.29 | 155 | 3 | 14.5 | 24 | — | 4.5 |
| Example 4 | 150 | 30 | 5.00 | 260 | 3 | 15.2 | 24 | — | 5.4 |
| Example 5 | 150 | 30 | 5.00 | 155 | 4 | 19.8 | 24 | — | 5.5 |

In the second example, the upper limit of L/h by the equation (18) when Vf=24 V is expressed as $$L/h \leqq 4.5 \quad (24\text{-}1).$$

In the configuration of the second example, since L=120 nm, h=30 nm and L/h=4.0, the equation (24-1) is satisfied. As compared to the first example, in the second example, by making the value of L smaller, the value of L/h also becomes smaller to be not larger than the upper limit expressed by the equation (24-1), so that it is indicated that the Coulomb force feedback runaway is not generated when Vf=24 V. On the other hand, when applying Vf=30 V at which the large current is generated in the second example to the equations (12) and (18), $$L/h \leqq 3.9 \quad (25)$$

is obtained, and the configuration L/h=4.0 in the second example does not satisfy this condition. It is indicated that when Vf is increased, the upper limit of L/h becomes smaller, and the Coulomb force feedback runaway occurs.

Third Example

Figure 16:
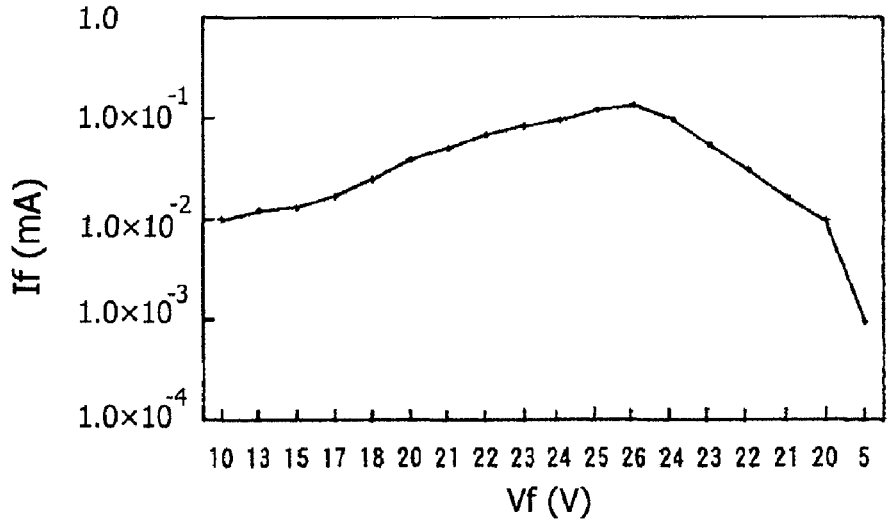
FIG. 16 is a view illustrating relationship between applied voltage and device current of the electron-emitting device of a third example of the present invention.

The electron-emitting device was manufactured in which the gate 5 was thicker than that in the first example, and the effect thereof was studied. Although the made device was similar to that of the first example, the thickness T2 of the gate 5 was set to 36 nm. As a result of the analysis by the cross-sectional TEM and the frontal SEM, the distance d of the gap 8 between the protrusion of the cathode 6 being the emitting unit and the gate 5 in FIG. 2 was 3 nm at the minimum and the average value thereof was 14.5 nm. When the property evaluation similar to that of the first example was performed by using the electron-emitting device thus obtained, as illustrated in FIG. 16, stable device current was obtained without occurrence of the sudden large current as in the first example in a range in which the voltage up to Vf=26 V was applied.

In the third example, the upper limit of L/h by the equation (18) when Vf=24 V is represented as $$L/h \leqq 4.5 \quad (24\text{-}2).$$

Since L/h=4.29 with L=150 nm and h=35 nm in the configuration of the third example, this satisfies the equation (24-2). In the third example as compared to the first example, the value of h is increased and the value of L/h becomes smaller to be not larger than the upper limit expressed by the equation (24-2), it is indicated that the Coulomb force feedback runaway does not occur when Vf=24 V.

Fourth Example

Figure 17:
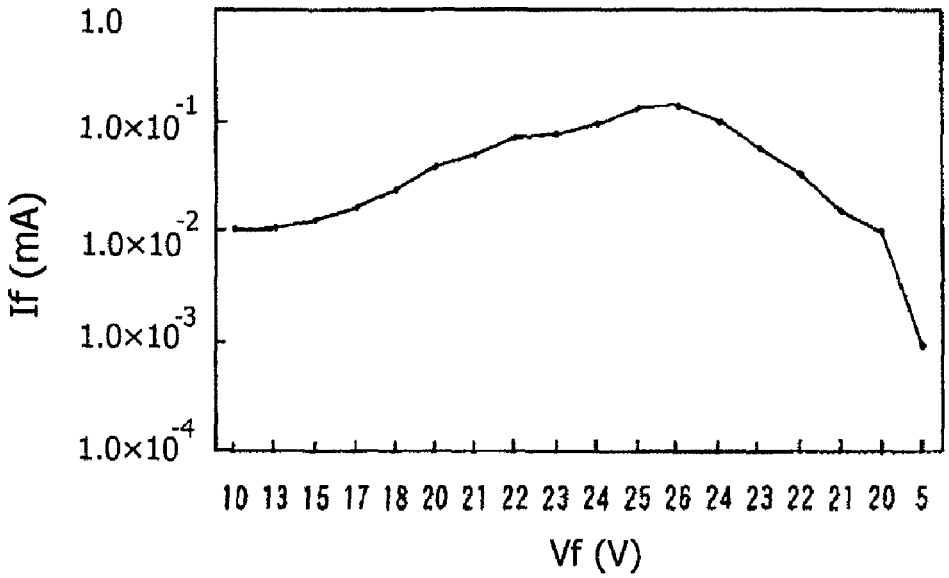
FIG. 17 is a view illustrating relationship between applied voltage and device current of the electron-emitting device of a fourth example of the present invention.

The electron-emitting device was manufactured in which the material having higher rigidity than that in the first example is used as the material of the gate 5, and the effect thereof was studied. Although the made device was similar to that in the first example, molybdenum was used as the material of the gate 5. When performing the property evaluation similar to that in the first example using the electron-emitting device thus obtained, as illustrated in FIG. 17, the stable device current was obtained without occurrence of the sudden large current as in the first example in a range in which the voltage up to Vf=26 V was applied. Also, as a result of the analysis by the cross-sectional TEM and the frontal SEM, the distance d of the gap 8 between the protrusion portion of the cathode 6 being the emitting unit and the gate 5 in FIG. 1 was 3 nm at the minimum and the average value thereof was 15.2 nm.

When applying the configuration in the fourth example to the equations (12) and (18), $$L/h \leqq 5.4 \quad (26)$$

is obtained by setting that the Young's modulus Y of molybdenum being the material of the gate 5 is equal to 260 GPa. As compared to the first example, in the fourth example, since the rigidity of the gate 5 is high, the upper limit of L/h also becomes high as expressed in the equation (26). Therefore, in the configuration of the fourth example, although L/h=5 as in the first example based on L=150 nm and h=30 nm, this satisfies the equation (26), and it is indicated that the Coulomb force feedback runaway is avoided.

Fifth Example

The electron-emitting device was manufactured in which the distance between the gate 5 and the protrusion of the cathode 6 was made larger than that in the first example, and the effect thereof was studied. Although the made device was similar to that in the first example, when forming the cathode 6, the deposition time of molybdenum was set to 2.2 minutes and it was formed such that the thickness of Mo on the outer surface of the insulating member was 26 nm. As a result of the analysis by the cross-sectional TEM and the frontal SEM, the distance d of the gap 8 between the protrusion of the cathode 6 being the emitting unit and the gate 5 in FIG. 2 was 4 nm at the minimum and the average value thereof was 19.8 nm.

Figure 18:
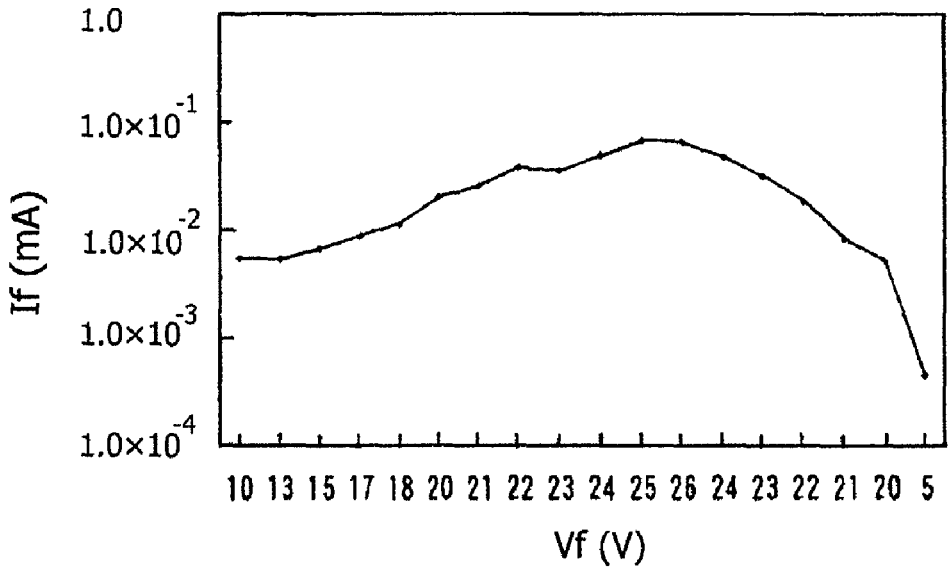
FIG. 18 is a view illustrating relationship between applied voltage and device current of the electron-emitting device of a fifth example of the present invention.

When performing the property evaluation similar to that in the first example by using the electron-emitting device thus obtained, as illustrated in FIG. 18, the stable device current was obtained without occurrence of the sudden large current as in the first example in a range in which the voltage up to Vf=26 V was applied.

When applying the configuration in the fifth example to the equations (12) and (18), $$L/h \leqq 5.5 \tag{27}$$

is obtained. As compared to the first example, in the fifth example, since the gap distance d is large, the upper limit of L/h also becomes high as expressed by the equation (27). Therefore, in the configuration of the fifth example, although L/h=5 as in the first example based on L=150 nm and h=30 nm, this satisfies the equation (27), so that it is indicated that the Coulomb force feedback runaway is avoided.

Sixth Example

Figure 19:
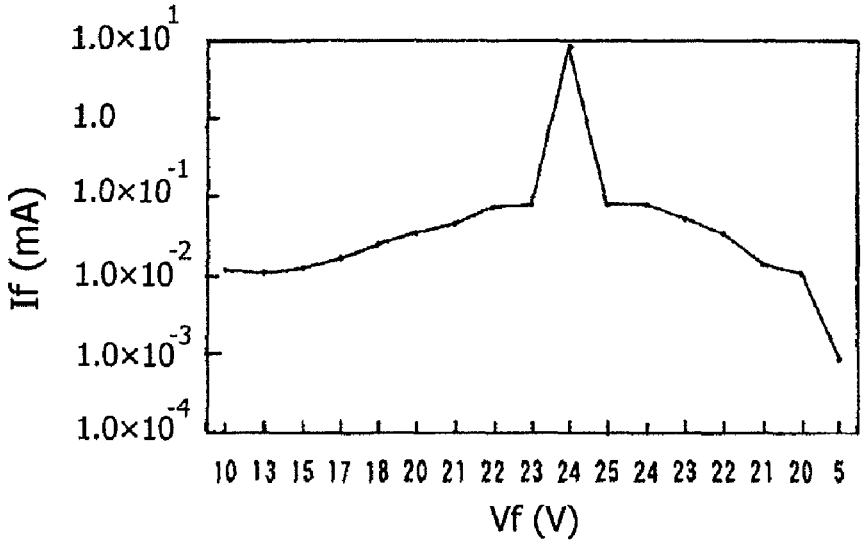
FIG. 19 is a view illustrating relationship between applied voltage and device current of the electron-emitting device of a sixth example of the present invention.

As illustrated in FIG. 10, the electron-emitting device was manufactured in which the film thickness of the gate 5 differs on the inner surface of the insulating layer 3*b* and the outer surface of the gate 5, and the effect thereof was studied. Although the made device was similar to that in the first example, when the gate 5 was formed of the Mo film by means of the sputtering, the thickness thereof was h2=20 nm on the outer surface and h1=30 nm on the position on the inner surface of the insulating layer 3*b*. As a result of the analysis by the cross-sectional TEM and the frontal SEM, the distance d of the gap 8 between the protrusion of the cathode 6 being the emitting unit and the gate 5 in FIG. 2 was 3 nm at the minimum and the average value thereof was 14.8 nm. When performing the property evaluation similar to that in the first example using the electron-emitting device thus obtained, as illustrated in FIG. 19, the large current was suddenly generated when Vf=24 V.

Since the configurations of the fourth and sixth examples are different only in the film thickness h2 on the outer surface of the gate 5, the configuration and property evaluation in the fourth and sixth examples were compared. In a table 2, the configuration of each example, presence or absence of large current generation and a value of upper limit of L/h by the equation (23) in the fourth and sixth examples and in a seventh example to be described hereinafter are arranged.

TABLE 2

| | L [nm] | h1 [nm] | h2 [nm] | h' [nm] | L/h' | Y [GPa] | d [nm] | dav [nm] | Vf | Presence of Large Current | Upper Limit of L/h defined by Equation (13) |
|---|---|---|---|---|---|---|---|---|---|---|---|
| Example 4 | 150 | 30 | 30 | 30.0 | 5.00 | 260 | 3 | 15.2 | 24 | — | 5.4 |
| Example 6 | 150 | 30 | 20 | 27.2 | 5.51 | 260 | 3 | 14.8 | 24 | PRESENT | 5.4 |
| Example 7 | 150 | 35 | 24 | 32.0 | 4.69 | 260 | 3 | 15.1 | 24 | — | 5.4 |

When applying the configuration in the sixth example to the equations (12) and (23), $$L/h' \leqq 5.4 \tag{28}$$

is obtained when Vf=24 V. In the fourth example as compared to the fourth example, L/h=5 based on h=30 nm and this satisfies the equation (26). On the other hand, in the sixth example, by substituting h1=30 nm and h2=20 nm to the equation (22), L/h'=5.51 is obtained based on h'=27.3 nm, so that this does not satisfy the equation (28). In the sixth example, since the equation (28) is not satisfied because the film thickness h2 on the outer surface of the gate 5 is thinner than that in the fourth example, and it is indicated that the Coulomb force feedback runaway occurs.

Seventh Example

Figure 20:
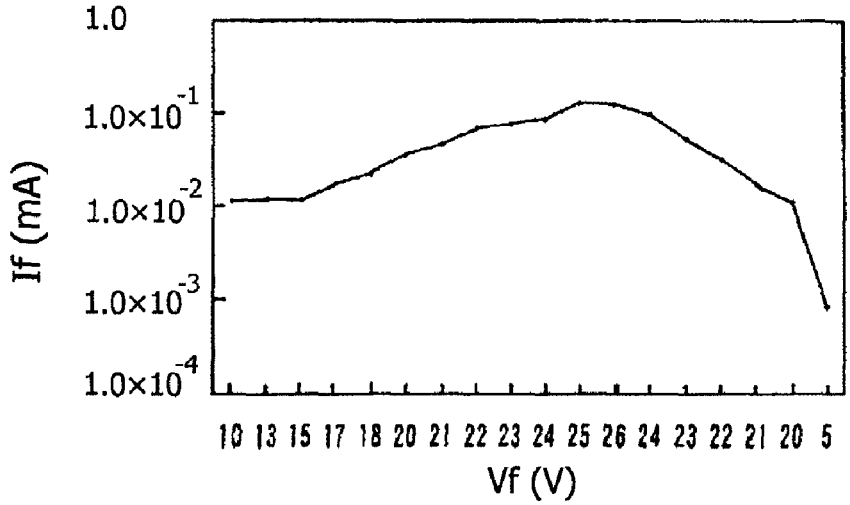
FIG. 20 is a view illustrating relationship between applied voltage and device current of the electron-emitting device of a seventh example of the present invention.

The electron-emitting device was made in which the film thickness of the gate 5 was made thick, and the effect thereof was studied. Although the made device was similar to that in the sixth example, the thickness of the gate 5 was h2=24 nm on the outer surface and h1=35 nm on the position on the inner surface of the insulating layer 4. As a result of the analysis by the cross-sectional TEM and the frontal SEM, the distance d of the gap 8 between the protrusion of the cathode 6 being the emitting unit and the gate 5 in FIG. 2 was 3 nm at the minimum and the average value thereof was 15.1 nm. When performing the property evaluation similar to that in the first example using the electron-emitting device thus obtained, as illustrated in FIG. 20, the stable device current was obtained without occurrence of the sudden large current as in the first example in a range in which the voltage up to Vf=26 V was applied.

In the seventh example, the upper limit of L/h' by the equation (23) is expressed as $$L/h' \leqq 5.4 \tag{28-1}$$

when Vf=24 V. In the configuration of the seventh example, by substituting h1=35 nm and h2=24 nm to the equation (22), L/h'=4.69 is obtained based on h'=32 nm, so that this satisfies the equation (28-1). As compared to the sixth example, by making the film thicknesses h1 and h2 of the gate 5 thicker, the value of L/h' becomes smaller to be not larger than the upper limit expressed by the equation (28-1), so that it is indicated that the Coulomb force feedback runaway is avoided.

While the present invent ion has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-117392, filed on May 14, 2009, which is hereby incorporated by reference herein in its entirety.

What is claimed is:

1. An electron beam apparatus, comprising:

an insulating member having a concave portion on a surface thereof;

a gate located on the surface of the insulating member;

a cathode having a protrusion portion protruding from an edge of the concave portion toward the gate, the protrusion portion located on the surface of the insulating member so as to be opposed to the gate; and an anode arranged so as to be opposed to the protrusion portion with the gate interposed between the protrusion and the anode, wherein following conditions are satisfied:

$$L/h \leqq 0.8 \times ((2 \times d^3 \times Y)/(27 \times c1 \times \epsilon 0 \times (d \times X/T2) \times Vf^2))^{1.0/3}$$

and $$2.7 \times T2 \leqq L,$$

where,

ϵ0 [F/m] is the vacuum permittivity,

Y [Pa] is a Young's modulus of the gate,

Vf [V] is voltage to be applied between the gate and the cathode, d [m] is minimum distance between the gate and the protrusion of the cathode, dav [m] is an average value of the distance between the gate and the protrusion of the cathode, a load coefficient c1=0.94×(d/dav)$^{1.78}$, h [m] is film thickness of the gate, T2 [m] is thickness of a portion having the concave portion of the insulating member, L [m] is distance from an outer surface of the gate to an inner surface of the concave portion, and X [m] is intruding distance of the cathode into the concave portion.

2. An electron beam apparatus, comprising:

an insulating member having a concave portion on a surface thereof;

a gate located on the surface of the insulating member;

a cathode having a protrusion portion protruding from an edge of the concave portion toward the gate, the protrusion portion located on the surface of the insulating member so as to be opposed to the gate; and an anode arranged so as to be opposed to the protrusion portion with the gate interposed between the protrusion and the anode, wherein following conditions are satisfied:

$$L \leqq 0.8 \times ((2 \times d^3 \times Y)/(27 \times c1 \times \epsilon 0 \times (d \times X/T2) \times Vf^2))^{1.0/3} \times h1 \times (0.5 + 0.5 \times (h2/h1)^{0.5})$$

and $$2.7 \times T2 \leqq L,$$

where,

ϵ0 [F/m] is a vacuum permittivity,

Y [Pa] is a Young's modulus of the gate,

Vf [V] is voltage to be applied between the gate and the cathode, d [m] is minimum distance between the gate and the protrusion, dav [m] is an average value of the distance between the gate and the protrusion, a load coefficient c1=0.94×(d/dav)$^{1.78}$, h1 [m] is film thickness on a position on an inner surface of the concave portion of the gate, h2 [m] is film thickness on an outer surface of the gate, T2 [m] is thickness of a portion having the concave portion of the insulating member, L [m] is distance from an outer surface of the gate to an inner surface of the concave portion, and X [m] is intruding distance of the cathode into the concave portion.

3. An image display apparatus, comprising:

the electron beam apparatus according to claim 1; and a light emitting member located so as to be laminated on the anode.

4. An image display apparatus, comprising:

the electron beam apparatus according to claim 2; and a light emitting member located so as to be laminated on the anode.

* * * * *